US005744205A

United States Patent [19]

Kawai et al.

[11] Patent Number: 5,744,205

[45] Date of Patent: Apr. 28, 1998

[54] SEMI-SEALED OR SEALED PACKAGE FOR PRESERVING PRODUCE COMPOSED OF RESIN COVERED PAPER

[75] Inventors: Yoshitake Kawai, Yokohama; Kazuo Taira, Tokyo; Kanemichi Yamaguchi, Yokohama, all of Japan

[73] Assignee: Toyo Seikan Kaisha, Ltd., Tokyo, Japan

[21] Appl. No.: 472,647

[22] Filed: Jun. 7, 1995

Related U.S. Application Data

[63] Continuation-in-part of Ser. No. 12,855, Feb. 3, 1993, abandoned.

[30] Foreign Application Priority Data

Feb. 6, 1992 [JP] Japan ..... 4-65481

[51] Int. Cl.[6] ..... B65D 85/34

[52] U.S. Cl. ..... 428/34.2; 428/34.3; 428/182; 428/511; 428/513; 428/211; 229/3.5 R; 229/120; 229/198.3; 229/939; 426/118; 426/127; 426/419

[58] Field of Search ..... 229/939, 198.2, 229/198.3, 120, 3.1, 3.5 R; 426/118, 127, 419, 415; 428/34.2, 34.3, 511, 182, 513, 192, 211

[56] References Cited

U.S. PATENT DOCUMENTS

| | | | |
|---|---|---|---|
| 1,025,444 | 5/1912 | Angier | 229/939 |
| 1,883,938 | 10/1932 | Killeffer | 229/198.2 |
| 2,391,791 | 12/1945 | McHenry | 229/3.1 |
| 3,659,772 | 5/1972 | Dorsey | 229/3.1 |
| 3,796,307 | 3/1974 | McKinney | 206/521 |
| 3,864,200 | 2/1975 | Marshall | 161/135 |
| 4,423,080 | 12/1983 | Bedrosian et al. | 426/124 |
| 4,806,399 | 2/1989 | Gibbons et al. | 428/34.2 |
| 4,859,513 | 8/1989 | Gibbons et al. | 428/34.2 |
| 4,897,274 | 1/1990 | Candida et al. | 426/127 |
| 4,898,773 | 2/1990 | Dethlefs et al. | 428/332 |
| 4,923,703 | 5/1990 | Antoon, Jr. | 426/118 |
| 5,116,649 | 5/1992 | Massouda | 428/34.2 |
| 5,160,768 | 11/1992 | Antoon, Jr. | 428/35.2 |
| 5,183,706 | 2/1993 | Bekele | 428/349 |
| 5,213,858 | 5/1993 | Tanner et al. | 428/34.2 |
| 5,225,256 | 7/1993 | Marano et al. | 428/34.2 |

FOREIGN PATENT DOCUMENTS

| | | |
|---|---|---|
| 0299033 | 10/1989 | Japan . |
| 3014480 | 1/1991 | Japan . |

*Primary Examiner*—Rena Dye

*Attorney, Agent, or Firm*—Beveridge, DeGrandi, Weilacher & Young, LLP

[57] ABSTRACT

A package and a method are disclosed for preserving freshness of produce using a corrugated fiberboard composed of an outer liner having a carbon dioxide permeability coefficient $P_{CO_2}$ of greater than $5\times10^{-10cm\ 3}$(STP)cm/cm$^2$·s·cmHg at a temperature of 27° C.; a corrugating medium; and an inner liner having a water-vapor transmission rate of less than 100 g/m$^2$·day at a temperature of 27° C. The end parts of the corrugated fiber board which are exposed to an outer surface of the package are substantially sealed with a seal tape. A wrapping paper covered at least on one surface thereof with a resin layer which contains therein less than 0.917 g/cm$^3$ density of a copolymer of ethylene and α-olefin having a carbon number of 3 to 12, having a carbon dioxide permeability coefficient of greater than $8\times10^{-10}$ cm$^3$(STP) cm/cm$^2$·s·cmHg, a permeability coefficient ratio $P_{CO_2}/P_{O_2}$ of greater than 3.5 and a water-vapor transmission coefficient of less than $80\times10^{-9}$ cm$^3$(STP)cm/cm$^2$·s·cmHg is also disclosed. With the use of the package or wrapping paper, produce can fall in a dormant condition, and the freshness thereof can be preserved so that the storage period therefor can be prolonged.

37 Claims, 5 Drawing Sheets

SEMI-SEALED OR SEALED PACKAGE FOR PRESERVING PRODUCE COMPOSED OF RESIN COVERED PAPER

This application is a continuation-in-part of application Ser. No. 08/012,855, filed on Feb. 3, 1993, now abandoned, which application is entirely incorporated herein by reference.

BACKGROUND OF THE INVENTION

The present invention relates to a package for and a method of preserving freshness of produce, using a packaging material composed of special corrugated fiberboard, and further, relates to wrapping paper for keeping a freshness of produce, a package formed of this paper, a method of sealing a produce fresh-keep package for keeping the freshness of produce with the use of the packaging material formed of special corrugated fiber board, and a produce fresh-keep pack thus formed.

Heretofore, various attempts have been made to keep freshness of produce. For example, there have been various methods, that is, produce is wrapped with a moisture impermeable packaging material in order to prevent dissipation of moisture, the preserving temperature is lowered, deoxidizer is used for restraining produce from breathing, ethylene gas is adsorbed so as to prevent additional maturity, and so forth.

For example, Japanese Patent Publication No. 38-2757 discloses a method in which produce is wrapped with a high pressure polyethylene film and is then refrigerated so as to prevent evapotranspiration of moisture and additional maturity in order to preserve the produce. Further, Japanese Laid-Open Patent No. 61-216640 discloses a method in which produce is wrapped with a synthetic resin film having a permeability ratio between carbon dioxide gas and oxygen ($Q_{CO_2}/Q_{O_2}$) of 3 to 4 in order to control breathing thereof for preservation. However, even with the use of these films, no sufficient fresh-keep effect for produce has been obtained. Further, Japanese Laid-Open Patent No. 1-317354 discloses a method in which the atmospheres inside of a corrugated fiber board box is turned into a condition of storage gas composition so as to cool and preserve produce. However, since the inside of the corrugated fiber board body is inevitably communicated with the outside due to its structure, this method is not effective. Further, Japanese Laid-Open Patent No. 2-233381 discloses a box or container made of corrugated board having an adjusted permeability ratios of oxygen gas and carbon dioxide gas. However, mere limitation to the permeabilities of both gases does not cause the atmospheric gas to have a necessary composition, and accordingly, this method is also not effective.

The conventional technology has not yet clearly solved the basic problem of why produce looses its freshness, and accordingly, no sufficient solution for keep-fresh preservation has been yet presented.

Through study made by the inventors, it has been found that produce exhibits vital reactions even during preservation thereof, and accordingly, it breathes, and the plant hormone or enzyme is active in it. Accordingly, if ethylene gas is present in a preservation atmosphere, the produce steadily secretes age hormone which promotes the aging of the produce. Further, the composition of the preservation atmosphere varies as the produce breathes so that a lower quantity of oxygen remains therein while increasing the quantity of carbon dioxide gas with which the produce performs non-aerobic respiration so as to promote alcoholic fermentation that synthesizes aldehyde and ethanol, causing the produce to lower its freshness. However, if the content of oxygen is large, brisk respiration is made so that the produce promotes its maturity. Thus, the composition of the preserving atmosphere has an important role for fresh-keeping produce, and accordingly, not only the quantity of carbon dioxide gas but also the quantity of oxygen should be is controlled to appropriate values.

Further, the produce has a high water content of 80 to 95%, and accordingly, if the produce is left as it is under a low humidity condition, it transpires rapidly water from its texture of pericarp or leaf. The loss of water causes at once the produce to wither, resulting in deterioration of freshness. In general, if higher than 5% of water is lost, any appreciable variation in appearance will occurs.

The inventors have studied the adjustment of the composition of gas in the preservation atmosphere in view of such a physiology of a plant.

As a result, it has been found that the following measures should be taken for keeping the freshness of produce:

(1) restraint of transpiration of water;

(2) adjustment of the quantity of oxygen existing in the preservation atmosphere to a range of 1 to 16%, preferably, 2 to 12%; and (3) reduction in the existing quantity of carbon dioxide in the preservation atmosphere to a range of 0 to 20%, preferably 2 to 15%.

Thus, as disclosed in Japanese Patent Application 2-103131, the inventors completed an invention relating to a packaging material for keeping the freshness of produce, which can create the above-mentioned preservation atmosphere, an which is formed of a synthetic resin film having a carbon dioxide permeability coefficient $P_{CO_2}$ of being greater than $15\times10^{-10}$ $cm^3(STP)cm/cm^2\cdot s\cdot cmHg$ at a temperature of 27.0° C., a ratio of carbon dioxide permeability coefficient $P_{CO_2}$ and oxygen permeability coefficient $P_{O_2}$ of being greater than 4.2 and a water-vapor permeability coefficient $P_{H_{2+sc}O}$ being less than $80\times10^{-9}$ $cm^3(STP)cm/cm^2\cdot s\cdot cmHg$.

The inventor has further studied, and has succeeded in improving a package made of paper, in particular, corrugated fiber board which is a packaging material that has been widely available, into the one having a produce fresh-keep function.

Further, it has been made clear that a sealed package such as a bag, a box or a tray made of paper for creating the above-mentioned special preservation atmosphere, and a corrugated fiber cardboard box having an outer layer liner made of this paper can exhibit an excellent preservation ability.

Through further study made by the inventor, it has been succeeded in improving a package made of paper, in particular, corrugated fiber cardboard which has been widely available into the one having a produce fresh-keeping function. Through further study, it has been found that a package made of corrugated fiber cardboard cannot be sealed by a usual sealing method due to the structure of the corrugated fiber cardboard. Thus, the present invention has been completed.

SUMMARY OF THE INVENTION

The composition of a preservation atmosphere varies as produce respires, and accordingly, the composition is shifted in a direction in which an equilibrium condition is held, that is, the equilibrium condition is to be maintained. If this equilibrium condition is maintained under the condition that non-aerobic respiration is not made, that the secretion of aging hormone is small, i.e. that the aging is not promoted while the respiration is made but the volume thereof is small, the freshness of produce can be maintained for a long time. That is, carbon dioxide gas produced through respiration by the produce in the preservation atmosphere is emitted outside of the atmosphere by a volume as large as possible while oxygen is introduced into the atmosphere by a suitable volume so as to balance the atmosphere in the above-mentioned ranges for holding the produce in a dormant condition, thereby it is possible to keep the freshness of the produce.

The inventors have carried out several kinds of studies in order to create the above-mentioned conditions, and concluded in novel knowledge such that produce cannot be set into a residing condition unless packaging materials are improved. Accordingly, the inventors have improved the packaging materials, and therefore completed the present invention.

Features of the present invention can be as follows:

(1) At first, if the carbon dioxide permeability coefficient $P_{CO_2}$ of the outer liner can be $5\times10^{-10}$ $cm^3$(STP)cm/$cm^2$·s·cmHg or greater. If not, the preservation atmosphere can be a dissatisfactory condition;

(2) Further, the ratio of the carbon dioxide permeability coefficient $P_{CO_2}$ and oxygen permeability coefficient $P_{O_2}$ of the atmosphere in the package can be 1.5 or more, because, if the ratio is less than 1.5, the concentrations of carbon dioxide gas and oxygen can be less controlable, even though the packaging materials can be bused to a certain extent, and accordingly, produce can be held in a dissatisfactory condition; and (3) The water-vapor transmission rate of an inner liner can be less than 100 g/$m^2$·day. If not, the transpiration of moisture from the produce is excessive since the discharge of moisture outside of the package can become large, causing the produce to be withered and the freshness of the produce can hardly be maintained, and further, since the transpiration moisture is shifted into the liner or the center corrugating medium of the cardboard, the strength of the package may be lowered.

Thus, a package which is excellent in the preservation of freshness has been devised.

Further, as to a wrapping paper sheet, the following problems have been considered to complete the present invention:

(A) It is preferable to coat the wrapping paper sheet with a resin layer which is necessarily made of a copolymer having a low density of 0.917 g/$cm^3$ or smaller, and consisting of ethylene and a-olefin having a carbon number of 3 to 12; and (B) Further, the resin layer with which the paper sheet is coated, can have the following characteristics:

(1) The carbon dioxide permeability coefficient $P_{CO_2}$ can be $8\times10^{-10}$ $cm^3$ (STP)cm/$cm^2$·s·cmHg or greater. If not, the preservation atmosphere cannot necessarily fall into a satisfactory condition;

(2) The ratio of carbon dioxide permeability coefficient $P_{CO_2}$ and oxygen permeability coefficient $P_{O_2}$ can be 3.5 or greater. If the ratio is less than 3.5, the concentrations of carbon dioxide and oxygen cannot be controlled sufficiently, and accordingly, produce cannot somtimes be held in a satisfactorily dormant condition;

(3) The water-vapor transmission coefficient $P_{H_{2+sc}\,O}$ can be $80\times10^{-9}$ $cm^3$(STP)cm/$cm^2$·s·cmHg or smaller. If not, the discharge of moisture outside of the wrapping paper sheet can become greater, so that the transpiration of moisture from the produce in the wrapping paper sheet tends to be excessive, causing withering, and accordingly, the freshness of the produce can be degraded.

Accordingly, the present invention can offer a synergetic effect for the fresh-keep of produce through the combination of some or all of the above-mentioned conditions.

Further, through various studies made by the inventors in order to create the above-mentioned conditions, the inventors had gained such a new knowledge that produce cannot fall into a dormant condition unless package materials were improved, and thus inventors improved the corrugated fiber board package material. However, a package formed of the corrugated fiber board could hardly keep its gas-tightness. With the results of various studies, it was found that the cause recites in the structure of the corrugated fiber board composed of an outer liner, an inner liner and a corrugating medium. Even though the gas-transmission caused by this structure is eliminated, the gas-tightness would be deteriorated with a high degree of possibility. With the result of investigation of the cause thereof, it has been found that the sealing for the corner parts of the package is insufficient, and accordingly, a sealing method and a package according to the present invention is completed.

According to a first aspect of the present invention, there is provided a package for preserving freshness of produce, formed of a corrugated fiber board composed of:

(A) an outer liner which can have a carbon dioxide permeability coefficient $P_{CO_2}$ of $5\times10^{-10}$ $cm^3$(STP)cm/$cm^2$·s·cmHg or greater at a temperature of 27° C.;

(B) a corrugating medium; and (C) an inner liner board which can have a water-vapor transmission rate of 100 g/$m^2$·day or smaller at a temperature of 27° C., and further, end parts of the corrugated fiber board which are exposed to an outer surface of the package can be substantially sealed with a seal tape.

According to a second aspect of the present invention, the package in the above-mentioned first aspect can have ratio $P_{CO_2}/P_{O_2}$ between carbon dioxide permeability coefficient and oxygen permeability coefficient which can be 1.5 or greater, even though there are acceptable cases where the ratio is less than 1.5.

According to a third aspect of the present invention, the inner liner of either the first or second aspect above can be a liner having a liner material layer, e.g. a resin layer, having a water-vapor transmission rate of 100 g/$m^2$·day or less at a temperature of 27° C. The liner mateiral layer can be formed at either side of the inner liner or formed or laminated between two other inner liner materials.

According to a fourth aspect of the present invention, the inner liner of any one of the first through third aspects above can be a liner having an innermost resin layer having a water-vapor transmission rate of 100 g/$m^2$·day or less at a temperature of 27° C.

According to a fifth aspect of the present invention, the outer liner of any one of the first through fourth aspects above can be a liner having a liner material on which is a resin layer having a carbon dioxide permeability coefficient of $5\times10^{-10}$ $cm^3$(STP)cm/$cm^2$·s·cmHg or greater at a temperature of 27° C. is laid. The liner material resin layer can be formed at either side of the outer liner or formed or laminated between two other outer liner materials. The liner material layer can be outer most layer of the outer liner.

According to a sixth aspect of the present invention, the outer liner or the liner material layer formed on the outer liner of any one of the first through fourth aspects above can be made of a resin layer which contains less than 0.917 g/cm$^3$ density of a copolymer of ethylene and α-olefin having a carbon number of 3 to 12, having a carbon dioxide permeability coefficient ratio $P_{CO_2}/P_{O_2}$ of $8\times10^{-10}$ cm$^3$(STP) cm/cm$^2$·s·cmHg or greater, a permeability coefficient ratio $P_{CO_2}/P_{O_2}$ of 3.5 or greater and a water-vapor transmission coefficient of $80\times10^{-9}$ cm$^3$(STP)cm/cm$^2$·s·cmHg or less, is laid.

According to a seventh aspect of the invention, the copolymer of the sixth aspect above can be ultra low density LLDPE having a density of 0.912 or less.

According to an eighth aspect of the invention, the seal tape of any of first through seven aspects above can completely seal surfaces of the exposed end part of the corrugated fiber board in a bottom, cover and corner portions of the packages, and also can seal the exposed end parts thereof in mated parts of the side surfaces of the package, excepting air-transmission adjusting parts. In this case, the $P_{CO_2}/P_{O_2}$ ratio can be less than 1.5 because the package itself is not completely sealed.

According to a ninth aspect of the present invention, there can be provided a package for preserving a freshness of produce, which is formed of a corrugated fiber board composed of:

(A) an outer liner that can have a carbon dioxide permeability coefficient of $5\times10^{-10}$ cm$^3$(STP)cm/cm$^2$·s·cmHg or greater at a temperatures of 27° C.; and (B) an inner liner, that can have end parts which are exposed to the outer surface of the package and which are substantially sealed by a seal tape, the package that can have a ratio $P_{CO_2}/P_{O_2}$ between carbon dioxide permeability coefficient and oxygen permeability coefficient of 1.5 or grater, excepting some cases;

(C) wherein the seal tape can be sealed to abutting parts of the corrugated fiber board in bottom and cover parts of the package so as to seal the inside of the package, a seal sheet having a length longer than that of the associated side of the package can be adhered to each of the corner parts over three surfaces of adjacent side portions and either the bottom or cover portion, end parts of the sheet which are not yet adhered to these surfaces can be sealed together so as to form a sealed piece surrounding and sealing the corner parts, while end parts of the sheets which are not sealed together and which are projected are adhered and fixed to the package, and a sealing tape can be adhered, for sealing, to the end parts of the corrugated fiber board which are exposed to the outer surface of the package in joined parts of the corrugated fiber board in the side surface portions of the package, excepting necessary gas transmission adjusting parts. The outer liner can have a resin layer having the carbon dioxide permeability coefficient at its either side. The inner liner can also have a resin layer having the $P_{CO_2}/P_{O_2}$ ratio at its either side.

According to a tenth aspect of the present invention, sealing to each corner part in the ninth aspect above can be made in such a way that one end part of the seal sheet sealed to one surface of the package is folded so as to seal one part thereof to another surface of the package while the remaining part thereof is sealed to the end part of the seal sheet adhered to the one surface so as to form a triangular sealed piece which surrounds and seal the corner part.

According to an eleventh aspect of the present invention, end parts of the seal sheet of ninth or tenth aspect which are not sealed together can be adhered and fixed to the rear surface of the seal sheet sealed to the package.

According to a twelfth aspect of the present invention, the inner liner of the ninth through eleventh aspects above can have an innermost layer which is a resin layer having a water-vapor transmission rate of 100 g/m$^2$·day or less at a temperature of 27° C. is laid.

According to a thirteenth aspect of the present invention, the outer liner of the ninth through twelfth aspects above can have an outermost layer which is a resin layer having a carbon dioxide permeability coefficient of $5\times10^{-10}$ cm$^3$ (STP)cm/cm$^2$·s·cmHg or grater at a temperature of 27° C. is laid.

Further, according to a fourteenth aspect of the present invention, a fresh-keep produce package wherein a produce can be stored in a package for preserving freshness of a produce, which is formed of a corrugated fiber board composed of:

(A) an outer liner having a carbon dioxide permeability coefficient of greater than $5\times10^{-10}$ cm$^3$(STP)cm/cm$^2$·s·cmHg or grater at a temperature of 27° C.; and (B) an inner liner, and having end parts which are exposed to the outer surface of the package and which are substantially sealed by a seal tape, the package having a ratio $P_{CO_2}/P_{O_2}$ between carbon dioxide permeability coefficient and oxygen permeability coefficient of 1.5 or greater excepting certain cases, and wherein the seal tapes can be sealed to abutting parts of the corrugated fiber board in bottom and cover parts of the package so as to seal the inside of the package, a seal sheet having a length longer than that of the associated side of the package can be sealed to each of the corner parts over three surfaces of adjacent side portions and either the bottom or cover portion, end parts of the sheet which are not yet sealed to these surface are sealed together so as to form a sealed piece surrounding and sealing the corner parts, while end parts of the sheets which are not sealed together and which are projected are sealed and fixed to the package, and a sealing tape can be adhered for sealing, to the end parts of the corrugated fiber board which are exposed to the outer surface of the package in joined parts of the corrugated fiber board in the side surface portions of the package, excepting necessary gas permeation adjusting parts.

According to a fifteenth aspect of the present invention, there is provided a fresh-keep produce package in that produce is stored in a package for preserving a freshness of produce, which can be formed of a corrugated fiber board composed of:

(A) an outer liner having a carbon dioxide permeability coefficient $P_{CO_2}$ of $5\times10^{-10}$ cm$^3$(STP)cm/cm$^2$·s·cmHg or greater at a temperature of 27° C.;

(B) a corrugating medium; and (C) an inner liner having a water-vapor, transmission rate of 100 g/m$^2$·day or less at a temperature of 27° C.;

wherein end parts of the corrugated fiber board which are exposed to an outer surface of the package can be substantially sealed with a seal tape, corner parts are also sealed with the seal tape, and the seal tape is sealed to the exposed end parts of the corrugated fiber board in joined parts of side surfaces of the package, excepting necessary gas-transmission adjusting parts, whereby the package can have a ratio $P_{CO_2}/P_{O_2}$ between carbon dioxide permeability coefficient and oxygen permeability coefficient of 1.5 or greater excepting certain cases.

According to sixteenth aspect of the present invention, there is provided a method of preserving a freshness of produce that produce is stored in a package for preserving a freshness of produce, which can be formed of a corrugated fiber board composed of:

(A) an outer liner having a carbon dioxide permeability coefficient $P_{CO_2}$ of $5\times10^{-10}$ $cm^3(STP)cm/cm^2\cdot s\cdot cmHg$ or greater at a temperature of 27° C.;

(B) a corrugating medium; and (C) an inner liner having a water-vapor transmission rate of 100 $g/m^2\cdot day$ or less at a temperature of 27° C.;

wherein end parts of the corrugated fiber board which are exposed to an outer surface of the package can be substantially sealed with a seal tape, corner parts are also sealed with the seal tape, and the seal tape can be sealed to the exposed end parts of the corrugated fiber board in joined parts of side surfaces of the package, excepting necessary gas-permeating adjusting of the parts, whereby the package can have a ratio $P_{CO_2}/P_{O_2}$ between carbon dioxide permeability coefficient and oxygen permeability coefficient of 1.5 or greater excepting certain cases.

According to a seventeenth aspect of the present invention, there is provided a produce wrapping paper covered at least one surface thereof with a resin layer which contains therein 0.917 $g/cm^3$ or less density of a copolymer of ethylene and α-olefin having a carbon number of 3 to 12, having a carbon dioxide permeability coefficient of $8\times10^{-10}$ $cm^3(STP)cm/cm^2\cdot s\cdot cmHg$ or greater, a permeability coefficient ratio $P_{CO_2}/P_{O_2}$ of 3.5 or greater and a water-vapor transmission rate coefficient of $80\times10^{-9}$ $cm^3(STP)cm/cm^2\cdot s\cdot cmHg$ or less.

According to an eighteenth aspect of the present invention, the copolymer of ethylene and α-olefin of the seventeenth aspect above can be ultra low density LLDPE having a density of 0.912 or less.

According to a nineteenth aspect of the present invention, a fold-proof fabricating type produce wrapping paper can be comprised of the resin coated paper of the seventeenth or eighteenth aspect above.

According to a twentieth aspect of the present invention, the wrapping paper of the eighteenth or nineteenth aspect above can be used for walls of a produce packing paper package.

According to a twenty-first aspect of the present invention, the wrapping paper of the eighteen or nineteenth aspect above can be used as a outer liner material for a produce preserving corrugated fiber board box.

According to a twenty-second aspect of the present invention, there is provided a method of sealing a package for preserving a freshness of produce, which can be formed of a corrugated fiber board composed of:

(A) an outer liner having a carbon dioxide permeability coefficient of $5\times10^{-10}$ $cm^3(STP)cm/cm^2\cdot s\cdot cmHg$ or greater at a temperature of 27° C.; and (B) an inner layer, and having end parts which are exposed to the outer surface of the package and which are substantially sealed by a seal tape, the package having a ratio $P_{CO_2}/P_{O_2}$ between carbon dioxide permeability coefficient and oxygen permeability coefficient of 1.5 or greater excepting certain cases;

(C) wherein the seal tape ca be sealed to abutting parts of the corrugated fiber board in bottom and cover parts of the package so as to seal the inside of the package, a seal sheet having a length longer than that of the associated side of the package is sealed to each of the corner parts over three surface of adjacent side portions and the bottom or cover portion, end parts of the sheet which are not yet sealed to these surfaces are sealed together so as to form a sealed piece surrounding and sealing the corner parts, while end parts of the sheets which are not sealed together and which are projected are sealed and fixed to the package, and sealing tape is sealed, for sealing, to the end parts of the corrugated fiber board which are exposed to the outer surface of the package in joined parts of the corrugated fiber board in the side surface portions of the package, excepting necessary gas transmission adjusting parts.

In the twenty-third aspect of the present invention, there is provided a method of sealing a package for preserving freshness of a produce according to the twenty-second aspect above, wherein sealing to each corner part can be made in such a way that one end part of the seal sheet sealed to one surface of the package is folded so as to seal one part thereof to another surface of the package while the remaining part thereof to another surface of the package while the remaining part thereof is sealed to the end part of the seal sheet adhered to the one surface so as to form a triangular sealed piece which surrounds and seals the corner part.

According to twenty-fourth aspect of the present invention, the end parts of the seal sheet, in the above-mentioned method of the twenty-third aspect which are not sealed together can be sealed and fixed to the rear surface of the seal sheet sealed to the package, In the twenty-fifth aspect of the present invention, these methods in the twenty-second through twenty-fourth aspects above use a corrugated box having an inner liner which can be made of a liner material including an innermost layer on which a resin layer having a water-vapor transmission rate of 100 $g/m^2\cdot day$ or less at a temperature of 27° C. is laid.

In the twenty-sixth aspect of the invention, these methods in the twenty second to twenty-fifth aspects use a corrugated fiber board box having an outer layer which can be made of a liner material including an outermost layer on which a resin covering having a carbon dioxide permeability coefficient of $5\times10^{-10}$ $cm^3(STP)cm/cm^2\cdot s\cdot cmHg$ or greater at a temperature of 27° C. is laid.

DESCRIPTION OF PREFERRED EMBODIMENTS

Figure 1:
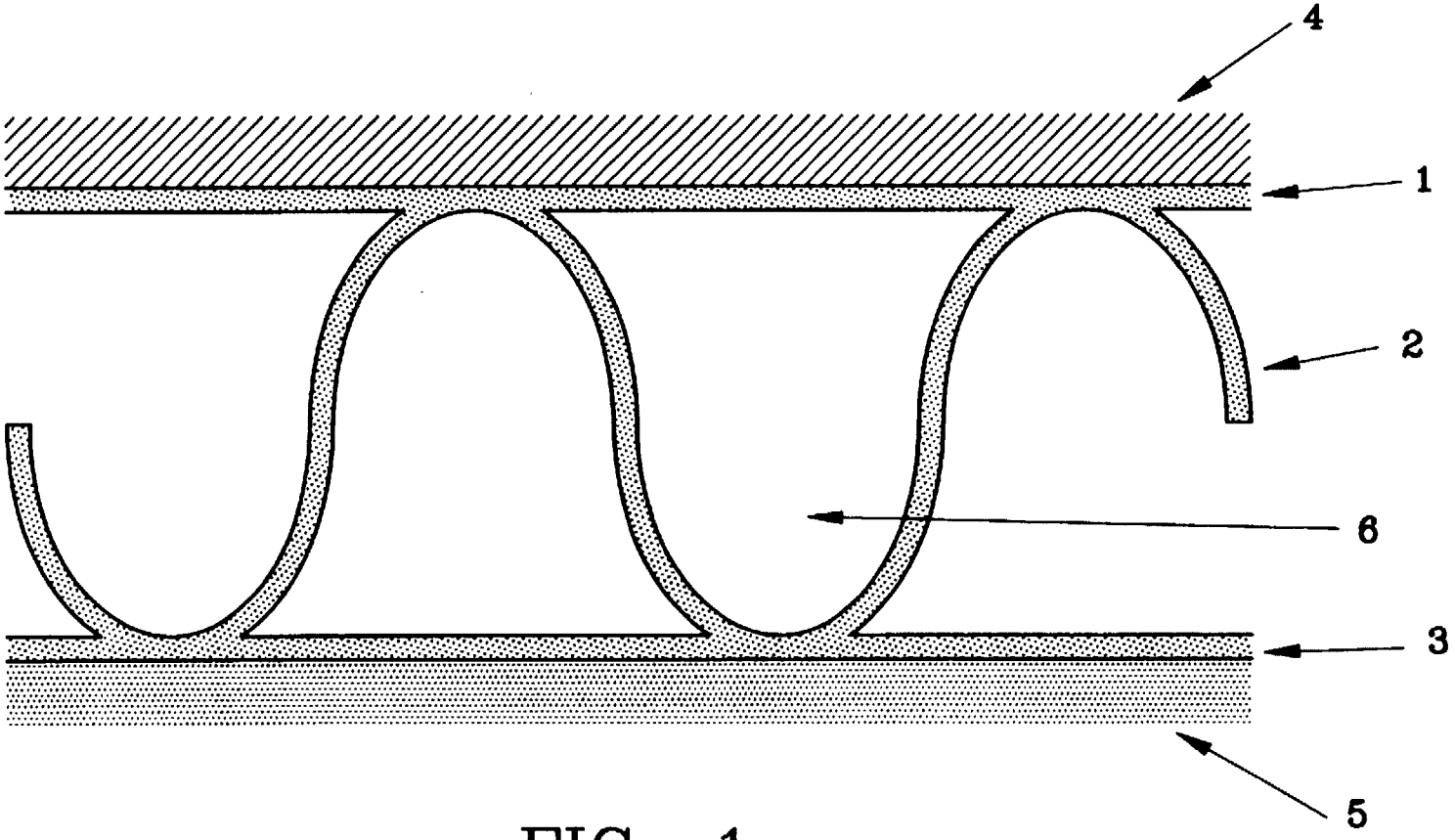
FIG. 1 is a cross sectional view illustrating a part of a wall of a corrugated fiber board package according to the present invention.

At first, explanation will be made of a package made of a corrugated fiber board, according to the present invention. The corrugated fiber board is composed of an outer liner, a center corrugating medium and an inner liner, the center corrugating medium being formed in a corrugated shape in order to effect a shock absorbing function. The structure of this corrugated fiber board greatly affects the creation and holding of a preservation atmosphere which is important in preserving a freshness of produce.

Further, paper constituting the corrugated fiber board has a water-vapor transmission rate and a gas-transmission, and accordingly, the preservation atmosphere varies through the intermediary of the wall of the package.

Accordingly, although the inventors tried applying various kind of processing to the inner wall of the package after the end parts of the corrugated fiber board which are exposed to the outside are sealed, no appreciable effect could not be obtained. Through further study, it has been found that, in a package formed of a corrugated fiber board, the troughs of the corrugating of the center corrugating medium at end faces of the corrugated fiber board which are exposed to the inside of the package, are communicated with the wall of the outer liner, and accordingly, the inside of the package is communicated with the outside through the intermediary of the outer liner having no resin coating, and the center corrugating medium, resulting in variation in the preservation atmosphere. The above-mentioned matter is a novel fact that the inventors have established for the first time.

As a result, even though the inner surface of the corrugated fiber board package is processed in various ways, gas in the package escapes from the wall of the outer liner, after passing through the troughs of the corrugating medium while the atmospheric air enters into the inside of the package, reversely.

In view of this novel knowledge, the inventors have established the following facts: it is necessary for the use of the corrugated fiber board package in the preservation of a freshness of produce to seal at least the end parts of the corrugated fiber board which are exposed to the outside; the outer liner of the corrugated fiber board can preferably have a carbon dioxide permeability coefficient $P_{CO_2}$ of $5\times10^{-10}$ $cm^3(STP)cm/cm^2\cdot s\cdot cmHg$ or greater; and the thus sealed package has to have a ratio of $P_{CO_2}/P_{O_2}$ between carbon dioxide permeability coefficient and oxygen permeability coefficient of 1.5 or greater, more preferably, 3.5 or greater.

Further, it is preferable to use a liner material having a water-vapor transmission rate of 100 $g/m^2\cdot day$ or less at a temperature of 27° C. as the inner liner, since moisture is emitted from produce through the vital reaction thereof so that not only the strength of the package can be lowered but also the humidity in the package can be lowered, if the package absorbs the moisture, resulting in promoted dehydration of the produce. For example, the inner layer made of a liner material having an innermost layer on which a resin layer having a water-vapor transmission rate of 100 $g/m^2\cdot day$ or less at a temperature of 27° C. is laid, can satisfy the preferred function.

Further, resin processing may be made to the liner material in order to obtain the above-mentioned water-vapor transmission rate.

In addition to an uniform coating film, a foamed resin coating layer may be used as the resin layer.

Further, the outer liner made of a liner material having an outermost layer on which a resin coating having a carbon dioxide permeability coefficient of $5\times10^{-10}$ $cm^3(STP)cm/cm^2\cdot s\cdot cmHg$ or greater at a temperature of 27° C. is laid, can satisfy the preferred function.

That is, if the outermost layer has the above-mentioned carbon dioxide permeability coefficient, it can be possible to control the gas passing through the wall of the package, and if the end parts of the corrugated fiber board which are exposed to the outside are sealed by a seal tape, the outflow and inflow of gas through the troughs of the center corrugating medium can be shut off. Further, it can be possible to prevent the corrugated fiber board from absorbing moisture.

It is likely to miss sealing the side surface parts of the corrugated fiber board package, although the upper and lower bottom and cover parts of the package are surely sealed by an adhesive tape during assembly of the package. However, the end faces of the corrugated fiber board in the side surface part on the outside can be exposed to the outside although the side surface parts of the corrugated fiber board are mated together, and accordingly, the passing of gas can be made through these end faces. The present invention can be characterized in that the sealing to the end faces of the corrugated fiber board in the mated parts of these side surface parts is adjusted in accordance with a kind of produce stored in the package so as to adjust the variation in the composition of gas, which is caused by the respiration of the produce.

Further, in order to preserve produce with the use of the package according to the present invention, after the produce is stored in the package, the end faces of the corrugated fiber board which are exposed to the outside can be sealed by a seal tape, and further, the seal tape is also applied, for sealing, to the corner parts which are likely to be easily broken with a high degree of possibility. Then, the open and parts of the corrugated fiber board in the side surface parts, can be sealed, excepting a gas-transmission adjusting area so as to adjust the ratio $P_{CO_2}/P_{O_2}$ between carbon dioxide permeability coefficient and oxygen permeability coefficient of the package to a value of 1.5 or greater, and accordingly, the produce can be set in a sufficient dormant condition, thereby it is possible to keep a freshness of the produce for a long period.

As will be explained in the later with the use of comparison tests, the preservation of a freshness of produce cannot be satisfactorily made, if some or all of the carbon dioxide permeability coefficient of the outer liner, the water-vapor transmission rate of the inner liner, and the ratio between carbon dioxide permeability coefficient and oxygen permeability coefficient do not fall in the respective ranges specified by the present invention.

Next, explanation will be made of the resin layer used in the present invention.

As to the characteristics of the outer liner, it may be required that the carbon dioxide permeability coefficient is $5\times10^{-10}$ $cm^3(STP)cm/cm^2\cdot s\cdot cmHg$ or greater, and the ratio $P_{CO_2}/P_{O_2}$ between carbon dioxide permeability coefficient and oxygen permeability coefficient is 1.5 or greater, and accordingly, the outer liner can to be formed of a nonporous dense resin layer. Low density polyethylene or resin containing as components, ethylene, α-olefin, vinyl acetate, acrylate, methacrylate or the like, such as a copolymer of ethylene and α-olefin, a copolymer of ethylene and vinyl acetate a copolymer of ethylene and acrylate, a copolymer of ethylene and methacrylate, and further polystyrene, styrene-butadiene copolymer and the like can be enumerated. Further, in order to improve the permeability of the resin and the adhesion thereof with respect to a paper base material, the above-mentioned base resin which is subjected to graft denaturation by silicone, maleic anhydride or the like is sometime used.

The resin layer which satisfies the permeability characteristic required in the present invention can be formed of synthetic resin alone but it is preferably formed from different kinds of synthetic resin in order to respectively satisfy the above-mentioned requirements having characteristics which are different from one other. As typical examples of these kinds of synthetic resin, a copolymer of ethylene and α-olefin having a carbon number of 3 to 12, such as an ethylene-butane-1 copolymer, an ethylene-hexene-1 copolymer, ethylene-4-metylpentene-1 copolymer, ethylene-octane-1 copolymer, and the like can be enumerated. Preferably, the blend of two kinds selected from the resin group consisting of the above-mentioned kinds, can be used. Further, the blend of the copolymer of ethylene and α-olefin having a carbon number of 3 to 12 and the low density polyethylene can be also used. In order to obtain a particularly high carbon dioxide permeability coefficient, a low density ethylene-α-olefin copolymer in which the copolymeric ratio of α-olefin is relatively high or a so called ultra low density ethylene-α-olefin copolymer in which the copolymeric ratio of α-olefin is high is preferably used as a main component. Further, in order to obtain a high perm-selectivity ratio, among the group consisting of the above-mentioned kinds of resin, a combination of at least two kinds which are composed of different monomers, such as a combination of low density polyethylene and an ethylene-hexene-1 copolymer, an ethylene-butane-1 copolymer and an ethylene-hexen-1 copolymer, or the like can be selectively and preferably used.

Further, as another method for obtaining a resin layer satisfying the requirement of permeation characteristics according to the present invention, only one of or a blend of a plurality of the above-mentioned kinds of resin is used as base polymer, and then an ethylene-vinyl acetate copolymer (EVA), an ethylene-acrylate copolymer, an ethylene-metylmethacrylate-nonconjugate dienenta-polymer, or resin such as hydrogen added substance of a styrene/butadiene block copolymer or styrene/isoprene block copolymer can be added thereto. If the above-mentioned resin is solely used, it is difficult to satisfy all the requirements concerning the permeability according to the present invention. Further since there is a tendency of lowering the strength of lamination with respect to paper or a tendency of occurrence of cracking or the like, it is desirable to use the above-mentioned resin having a blend ratio of 90:10 to 50:50 with respect to the above-mentioned base polymer.

Thus, although the reason why the perm-selectivity ratio between carbon dioxide gas and oxygen becomes larger by blending a plurality of kinds of resin having different cyclic units is not clear in detail, the inventors consider that this is caused by such a fact that a region in which molecular chains having different molecular motions exist with different concentrations, is present, and the permeabilities of gases thereof vary in dependence upon the concentrations of the molecular chains in this region.

As to the characteristics of the inner liner, and kind of resin having a water-vapor transmission rate of 100 $g/m^2$·day or less at temperature of 27° C. can be used. Of the above-mentioned kinds of resin used for the liner, the one having a relatively high density and having ethylene as a main component is preferably used. In addition to that, a copolymer resin having high density polyethylene, polypropylene or propylene as a main component or foamed resin can be used. In these cases, in order to effectively prevent the pressure-proof strength from lowering due to moisture absorption, a material and a thickness thereof with which the water-vapor transmission rate of the inner layer becomes lower than that of the outer liner are preferably selected.

With the liner material having the above-mentioned resin layer, it is important in ensuring a desired package function to prevent the resin layer from cracking and so forth during fabrication thereof for a corrugated fiber board or to prevent occurrence of such defects or delamination during use. In particular, if cracking or delamination occurs in the resin layer on the outer liner, it is difficult to ensure the permeability coefficient ratio $P_{CO_2}/P_{O_2}$ which is 1.5 or greater.

The resin layer can be blended with antioxidant or heat stabilizing agent of a phenol group, an organic sulfur group, an organic nitrogen group, an organic phosphorus group or the like, lubricant such as fatty acid derivative, for example, metallic soap or other fatty acid ester, antifogging agent, anticharge agent, or filler of inorganic group including calcium carbonate, white carbon, titanium white, magnesium carbonate, magnesium silicate, carbon black, several kinds of clay and natural or synthetic zeolite, pigment or the like, with the use of method which is well-known per se by a blend ratio which is also well-known per se.

It is required to suitably set the thickness of the coating resin layer in accordance with kind of resin to be used, or a physical strength thereof, or in consideration with the relationship of a characteristics of paper to be used, and further, in a certain case, in consideration with a kind of produce to be packed, a preservation temperature or the like. In general, it is suitable to set the thickness to a value in the range of 5 to 60 μm, preferably, 10 to 40 μm.

The melt index (MI) of the resin used by the present invention is suitably set to a value in a range of 0.1 to 30 g/10 minutes, preferably, 0.1 to 10 g/10 minutes (in conformity with JIS-K-6760).

The resin layer according to the present invention can be formed, in general, of an extruded lamination or a laminate of resin films or sheets. Further, in order to improve the adhesion to the paper and the surface characteristics of the coating resin film, a lamination using multi-layer dies, or a multi-layer film which is previously formed by using multi-layer dies can be used. Further, although it is preferable to lay a predetermined coating resin layer on the outermost layer of each layer material, a layer made of a porous plastic film or paper or synthetic paper having a relatively small weight can be laid thereon with the use of a sand-laminating method, a dry laminating method or the like, if the permeability coefficient ratio $P_{CO_2}/P_{O_2}$ is ensured as being 1.5 ir greater.

Further, in addition to the above-mentioned method, it is possible to form the resin layer by subjecting a previously formed film to dry or wet lamination or by coating or impregnating a liner material with a solution or dispersion of a paint and thereafter by drying the material.

As to the paper used for the corrugated fiber board, there can be used paper by made from cellose pulp, such as craft paper, art paper, general printing paper, rolled paper or thin sheet paper, or the so-called board, for example, white board such as corrugated fiberboard material paper, manila paper or white board. Further, there can be also used paper in which synthetic resin fibers made of polyethylene or the like is mixed.

Printing on the outer surface of the resin layer provided on a corrugated fiber board is preferable in order to ensure an aesthetic appearance, and further the printing can be made on the paper prior to forming the resin layer on the paper. As to the printing method therefor, a well-known printing method such as a gravure method, a flexiso method or silk screen method can be used, since the printing method provides the thin printing layer without a continuous film, and affection upon the permeability is extremely slight. If printing is made on the outer surface of the resin layer, it is effective to apply a process such as a corona discharge process or the like to the resin layer with the use of a well-known method after the formation of the coating resin layer or before the formation of the same in the case of a film in order to enhance the ink adhesion and the scratch damage resistance.

On use of the corrugated fiber board according to the present invention, it is possible to co-use a well-known measures for preserving a freshness of produce. For example, gas adsorptive for gas such as ethylene or formaldehyde gas generated from produce, moisture retentive agents or moisture adsorbents for controlling moisture, deoxidants, carbon dioxide remover or the like can be sometimes more effective in view of the preservation of a freshness.

The above-mentioned adjuvant is used being disposed in a separate bag set in the inside of the corrugated fiber board package, but in a certain case, it can be applied to the liner so as to coat the liner therewith, or can be mixed in pulp during making the liner. Further, it can be mixed in coating resin.

In order to seal the corrugated fiber board package after filling contents thereinto, an I-seal, an H seal or the like which is well-known is used, and further, an automatic machine or a manual machine such as a hand sealer can be used therefor. In the case of the H-seal, it is necessary to take a measure for blocking a gap in each corner of the corrugated fiber board package. If the sealing to each corner part is insufficient, it is difficult to hold the permeability coefficient ration $P_{CO_2}/P_{O_2}$ which is 1.5 or greaer. Further, by changing the sealing width at the exposed end part of the corrugated fiber board in the mated parts of the side surface parts, the concentrations of oxygen and carbon dioxide gas can be adjusted in a suitable range. This method is effective for contents which respire with a relative larger volume. A material having a gas-transmission which is smaller than that of the outer liner is suitable for a tape for sealing. Although it should not be limited to, a material such as biaxially stretched nylon or high density polyethylene is suitable, having a thickness of 20 to 80 μm, preferably, 30 to 50 μm, and a width of 20 to 80 mm. Since produce is stored, an adhesive having a moisture resistance is suitably used, and further, the one having a cold resistance is suitable for storage or physical distribution under a low temperature condition.

Then, explanation will be made of a sealing method.

As mentioned above, the corrugated fiber board is composed of the outer liner, the center corrugating medium and the inner liner, the center corrugating medium being corrugated in order to exhibit a shock absorbing function.

Further, since the paper with which the corrugated fiber board is formed has water-vapor transmission and gas-transmission characteristics, the preservation atmosphere varies through the wall of the package.

Accordingly, the inventors applied several kinds of processing to the wall of the package after the end parts of the corrugated fiber board which are exposed to the outside are sealed, but no appreciable effects could be obtained. After further study for ascertaining the reason why it could not be sealed satisfactory, it was found that this is caused by the structure of the corrugated fiber board. In a package made of corrugated fiber board, troughs of corrugation of the center corrugating medium at end faces of the corrugate fiber board which are opened to the inside of the package, are communicated with the wall of the outer liner, and accordingly, the inside of the package is communicated with the outside through the intermediary of the outer liner and the troughs of the center corrugating medium so that the preservation atmosphere varies. This fact has been made to be clear by the inventors for the first time.

As a result, even though the inner surface of the corrugated fiber board package is processed in several ways, gas escapes from the package, passing through the troughs of the center corrugating medium and the wall of the outer liner while the atmospheric air enters into the package through the reverse course.

In view of this knowledge, the inventors found the following matters: at least end parts of the corrugated fiber board which are exposed to the outside of the package have to be sealed in order to use the corrugated fiber board package for preserving a freshness of produce; the outer liner of the corrugated fiber board has to have a carbon dioxide permeability coefficient $P_{CO_2}$ of $5\times10^{-10}$ $cm^3$(STP) $cm/cm^2\cdot s\cdot cmHg$ or greater at a temperature of 27° C.; and the thus sealed package has to have a ratio $P_{CO_2}/P_{O_2}$ between carbon dioxide permeability coefficient and oxygen permeability coefficient of 1.5 or greater. Accordingly, the present invention has been completed.

Further, if the inner liner absorbs moisture which is discharged from produce in the package through its vital reaction, since not only the strength of the package is lowered but also the humidity of the inside of the package is lowered so as to promotes the dehydration of the produce, the inner liner is preferably made of a liner material having its innermost layer laminated with a resin layer which has a water-vapor transmission rate of 100 $g/m^2\cdot day$ or less at a temperature of 27° C. in order to satisfy a preferred function. Of course, it is possible to apply a process for impregnating the liner material with resin or the like in order to adjust the water-vapor transmission rate.

Further, the outer liner made of a liner material having its outermost layer laminated thereon with a resin coating having a carbon dioxide permeability coefficient of $5\times10^{-10}$ $cm^3$(STP)$cm/cm^2\cdot s\cdot cmHg$ or greater at a temperature of 27° C. can satisfy the function which is required when the sealing is made.

It is important to lay the above-mentioned coating on the outermost layer. Should it be laid on the inner layer, gas should be discharged through the outer liner, and the atmospheric air should be introduced into the package through the reverse course. Accordingly, the gas-transmission of the outermost layer of the liner should be controlled.

That is, the outermost layer having the above-mentioned carbon dioxide permeability coefficient can control the passing of gas through the wall of the package, and the end parts of the corrugated fiber board which are exposed to the outside of the package and which are sealed by the seal sheet can shut off the discharge and inflow of gas through the troughs of the corrugating medium. Further, the moisture absorption of the corrugated fiber board and the dehydration of the produce can be prevented by controlling the permeability of the innermost layer of the inner liner.

It is likely to miss sealing the side surface parts of the corrugated fiber board package although the upper and lower bottom and cover portions of the package are sufficiently sealed after assembly thereof. However, in the side parts of the package, the end faces of the corrugate fiber board on the outside are exposed to the outside although parts of the corrugated fiber board are mated together in these side parts, and accordingly, gas is discharged and introduced from and into the package from these end faces by way of the troughs of the corrugating medium. The present invention also offers such a feature that the sealing to the end faces of the corrugated fiber board in the side surface parts of the package is adjusted in accordance with produce stored in the package so as to control the variation in the gas composition caused by the respiration of the produce in the package. It is natural that the end faces can be completely sealed.

Next explanation will be made of the sealing to the corner parts of the package which is the most important feature of the present invention.

Even though the package can satisfy all of the above-mentioned requirements, there have been found that insufficient sealing frequently occurs. With the result of study made by the inventors in this regard, it has been found that a corrugated fiber board package has portions where the sealing is fragile, which are in the corner parts of the package. Several end faces of the corrugated fiber board assemble together in the corner parts due to the structure of the latter in which the three wall surfaces of the package are orthogonal to one another. Further, since the material of the corrugated fiber board is paper so that precise abutment cannot be made, gaps are inevitably formed with a high degree of possibility. Further, although a seal sheet is adhered, the seal sheet cannot be satisfactorily adhered to the apex of each corner part defined by three surfaces of the package, which are orthogonal to each other. Further, since only seal sheet is applied over such three surfaces of the package, it is likely that wrinkling occurs in the seal sheet, and accordingly, it is also likely to communicate the apex of each corner part with the outside.

Thus, according to the present invention, end part of a seal sheet which has been at first adhered between two adjacent side surfaces or between one side surface and a cover or bottom of the package is folded toward and adhered to the other surface, further, the folded parts and parts adjacent thereto are adhered to the other surface, and parts of the end parts of the seal sheet adhered to the two surfaces, which are not yet adhered are sealed together so as to form triangular sealed pieces. Thereby the corner parts are completely surrounded and sealed by the seal sheet with no wrinkles occurring in the seal sheet.

When such sealing is made, however, the sealed pieces rise up outward around the corner parts of the package, resulting in difficulty in handling. Further, since adhesive parts which have not yet sealed together regain, these parts are possibly sealed to other objects so as to cause a risk of tearing.

Thus, the sealed pieces in which the end parts of the seal sheet are sealed to one another are adhered and fixed to the package or to the seal sheet adhered to the package, with the use of the remaining adhesive layer.

Further, in order to preserve produce with the use of the package according to the present invention, the produce is stored in a corrugated fiber board package used by the present invention, end faces of the corrugated fiber board which are exposed to the outside are sealed by a seal sheet, and further, the corner parts where the sealing is most fragile are sealed for sealing with the seal sheet. Then, the open end parts of the corrugated fiber board in the side surface parts of the package are sealed, excepting permeability adjusting regions suitable for a kind of the produce so as to adjust the ratio $P_{CO_2}/P_{O_2}$ between carbon dioxide permeability coefficient and oxygen permeability coefficient of the package to a value 1.5 or greater. Thereby, the produce can fall in a dormant condition for preserving a freshness of the produce for a long period.

As will be explained later with the use of comparison test, if the carbon dioxide permeability coefficient of the outer liner and the ratio between carbon dioxide permeability coefficient and oxygen permeability coefficient do not fall in the respective specific ranges of the present invention, the preservation of a freshness of produce cannot be made. Further, if method of sealing the corner parts of the package other than the method according to the present invention are used, the freshness of the produce cannot be preserved.

Next, a wrapping paper according to the present invention will be explained. At first explanation will be made of a resin layer with which the wrapping paper is coated.

The resin layer satisfying the requirements for the permeability according to the present invention, can be formed of only one kind of synthetic resin, but is preferably composed of different kinds of synthetic resin in order to respectively satisfy the above-mentioned requirements whose characteristics are different from one another. As typical examples of these kinds of synthetic resin, a copolymer of ethylene and α-olefin having a carbon number of 3 to 12, such as an ethylene-butane-1-copolymer, an ethylene-hexene-1 copolymer, ethylene-4-methylpentene-1 copolymer, ethylene-octene-1 copolymer, and the like can be enumerated. Preferably the blend of two kinds selected from the resin group consisting of the above-mentioned kinds, can be used. Further, the blend of the copolymer of ethylene and α-olefin having a carbon number of 3 to 12 and the low density polyethylene can be also used. In order to obtain a particularly high carbon dioxide permeability coefficient, a low density ethylene-α-olefin copolymer in which the copolymeric ratio of α-olefin is relatively high or the so-called ultra low density ethylene-α-olefin copolymer in which the copolymeric ratio of α-olefin is high is preferably used as a main component. Further, in order to obtain a high perm-selectivity ratio, among the group consisting of the above-mentioned kinds of resin, a combination of at least two kinds which are composed of different monomers, such as a combination of low density polyethylene and an ethylene-hexene-1 copolymer, an ethylene-butane-1 copolymer and an ethylene-hexen-1 copolymer, or the like can be selectively and preferably used.

Further, as another method for obtaining a resin layer satisfying the requirement of permeation characteristic according to the present invention, only one or a blend of a plurality of the above-mentioned kinds of resin is used as base polymer, and then an ethylene-vinyl acetate copolymer (EVA), an ethylene-acrylate copolymer, an ethylene-metylmethacrylate-nonconjugate dienenta-polymer, or resin such as hydrogen added substance of a styrene/butadiene block copolymer or styrene/isoprene block copolymer can be blended thereinto. As will be explained in the latter embodiments, if the above-mentioned resin is solely used, it is difficult to satisfy all the requirements concerning the permeability according to the present invention. Further since there is a tendency of lowering the strength of lamination with respect to paper or a tendency of occurrence of cracking or the like, it is required to use the above-mentioned resin having a blend ratio of 90:10 to 50:50 with respect to the above-mentioned base polymer.

Thus, although the reason why the perm-selectivity ratio between carbon dioxide gas and oxygen becomes larger by blending a plurality of kinds of resin having different cyclic units, is not clear in detail, the inventors consider that this is caused by such a fact that a region in which molecular chains having different molecular motions exist with different concentrations, is present, and the permeabilities of gases thereof vary in dependence upon the concentrations of the molecular chains in this region.

The resin layer can be blended with antioxidant or heat stabilizing agent of a phenol group, an organic sulfur group, an organic nitrogen group, an organic phosphorus group or the like, lubricant such as fatty acid derivative, for example, metallic soap or fatty acid ester, antifogging agent, anticharge agent, filler of inorganic group including calcium carbonate, white carbon, titanium white, magnesium carbonate, magnesium silicate, carbon black, several kinds of clay and natural or synthetic zeolite, pigment or the like, with the use of a method which is well-known per se by a blend ratio which is also well-known per se.

It is required to suitably set the thickness of the coating resin layer in accordance with a kind of resin to be used, or a physical strength thereof, or in consideration with the relationship of a characteristic of paper to be used, and further, in a certain case, in consideration with a kind of produce to be packaged, a preservation temperature or the like. In general, it is suitable to set the thickness to a value in a range of 5 to 60 μm, preferably, 10 to 40 μm.

The melt index (MI) of the resin used by the present invention is suitably set to a value in a range of, preferably, 0.1 to 10 g/10 minutes (in conformity with JIS-K-6760).

The resin layer according to the present invention can be formed of an extruded lamination or a laminate of resin films or sheets. Further, in order to improve the adhesion to the paper and the surface characteristics of the coating resin film, a lamination using multi-layer dies, or a multi-layer film which is previously formed by using multi-layer dies can be used. In this case, it is natural that these multi-layer resin layer can satisfy the permeabilities specified by the present invention or claims.

The application of printing to the outer surfaces of these resin layers is of course preferable in view of ensuring the aesthetic appearance of the package. Further, the printing can be made before the resin layer is formed on paper. Since a printed layer is thin and is not formed of a continuous film, affection upon the permeability is extremely slight. In particular, in the former case, it is effective to apply a corona discharge process or the like after the resin coating or before the same in the case of the film, with the use of a well-known method, in view of enhancing the adhesion of ink and preventing damage.

As to the paper according to the present invention, there can be used paper made from cellose pulp, such as Kraft paper, art paper, general printing paper, rolled paper or thin sheet paper, or the so-called paper board, for example, white board such as corrugated fiber board material paper, manilla board or white board. Further, there can be also used paper in which synthetic resin fibers made of polyethylene or the like is mixed.

The wrapping paper according to the present invention can be used as usual wrapping paper so that produce is wrapped and sealed up by sealing mated parts of the wrapping paper, and further it can be used in the form of a bag or a box-like container in which the produce is stored and then which is sealed by sealing or covering the opening thereof. The thus sealed bag or the container has a suitable inside atmosphere so that the freshness of the produce can be held.

Upon use of the wrapping paper according to the present invention, it is possible to use a well-known measures for preserving a freshness of produce. For example, gas adsorptive for gas such as ethylene or formaldehyde generated from produce, moisture retentive agent or moisture absorbent for controlling moisture in the bag, deoxidant, carbon dioxide remover or the like can becomes sometimes more effective in view of the preservation of freshness.

The above-mentioned adjuvant is used being disposed in an separate bag set in the inside of a pack wrapped by the wrapping paper according to the present invention, but in a certain case, it can be effectively applied to the liner so as to coat the liner therewith, or can be mixed in pulp during making the liner. Further, it can be mixed in coating resin.

The transfer of gas which occurs between the atmosphere in the pack and the outside during preservation of produce will be briefly explained. Carbon dioxide gas $CO_2$ generated through the respiration of the produce permeates through the wrapping paper and is emitted to the atmosphere. Meanwhile oxygen $O_2$ to be consumed through the respiration of the produce. enters into the pack from the atmosphere through the wrapping paper. It is importantly noted here that carbon dioxide gas is emitted to the atmosphere by a volume as large as possible so as to reduce the remaining quantity of carbon dioxide gas in the pack as small as possible while oxygen entering into the pack is controlled so as to set the remaining amount thereof in the pack to a value with which a necessary but minimum degree of respiration can be performed.

Further, as to other advantageous effects which can be obtained by use of wrapping paper according to the present invention, since the wrapping paper according to the present invention has a high gas-transmission so that ethylene gas discharged from produce can be effectively emitted to the outside, it is possible to restrain the concentration of ethylene gas from increasing, thereby it is possible to prevent the produce from aging.

The technical effects will be detailed by the description of embodiments with the use of comparison test. However it was found that the adjustment according to the present invention can increase the days of preservation of freshness by 150% in comparison with a conventional pack. The wrapping paper according to the present invention has to have a carbon dioxide permeability coefficient $P_{CO_2}$, a ratio between carbon dioxide permeability coefficient $P_{CO_2}/P_{O_2}$ and oxygen permeability coefficient ratio and a water-vapor transmission rate coefficient $P_{H_2+sc\ O}$ all of which fall in the respective specific ranges. This fact will be explained in the term of embodiments which will be detailed hereinbelow.

Further, the wrapping paper according to the present invention is excellent in folding process ability, and accordingly, even though it is folded, no detrimental affection can be given to the gas-transmission and the water-vapor transmission rate. These properties are extremely effective when a container such as a box is formed.

Although the present invention will be hereinbelow specifically explained, as to produce whose freshness can be suitably preserved by the package according to the present invention, citrus fruits such as *yuzues* or *sudachies*, apples, sweet corns, leeks or tomatoes, to which CA is effective, or greens such as asparagus or broccoli, raw shiitake, cherries to which restraint to transpiration is effective, can be used in addition to those explained in the embodiments. Further, heat regenerative agent, dry ice, ice or the like can be additionally used for crops which require low temperature storage.

In addition to the above-mentioned operations and advantageous effects, according to the present invention, the following advantageous effect can be also obtained: with the use of a corrugated fiber board, the ratio between the outer surface area of the package and the volume of the content can be freely set in accordance with a degree of respiration of the content so as to optimumly set the gas composition in the package; an extra space can be obtained for crops whose respiration is high, without the crops being closely packed; and it is possible to prevent pin holes from being formed in the package materials, in particular, in the outer liner.

DESCRIPTION OF THE PREFERRED EMBODIMENTS

Embodiments of a package for preserving a freshness of produce and a fresh preserving pack will be at first explained, and then a sealing method will be explained with respect to wrapping paper.

Referring to FIG. 1 which is a sectional view illustrating a part of the wall of a corrugated fiber board package according to the present invention, there are shown an outer liner 1 having its outermost layer on which a coating resin layer 4 is laid so that the passing of gas through the wall surface of the outer liner is controlled by the coating resin layer, a corrugating medium 2 which is corrugated so as to define thereon troughs 6, and an inner liner 3 having an innermost layer on which a water-proof coating resin layer 5 is laid so that the transfer of water-vapor through the resin layer is restrained.

Figure 2:
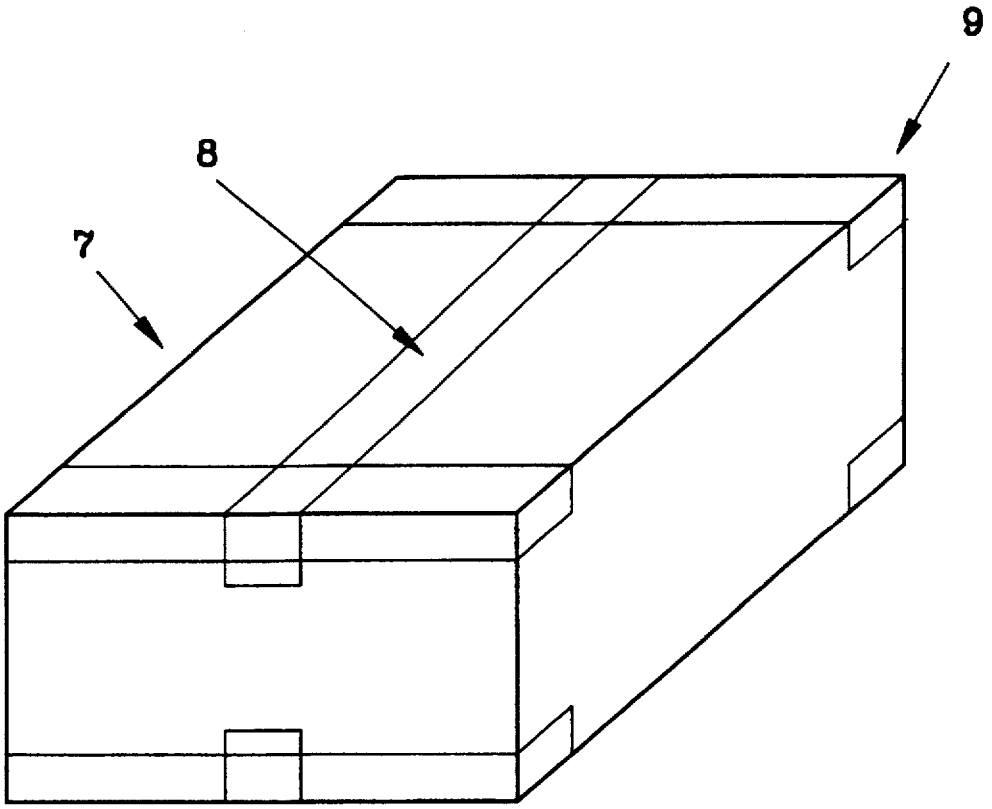
FIG. 2 is a perspective view illustrating the corrugated fiber board package in an assembled form, according to the present invention.

Referring to FIG. 2 which is a perspective view illustrating the corrugated fiber board package 7 is an assembled condition according to the present invention, exposed end parts of the corrugated fiber board at the cover and bottom of the package are sealed by a seal tape 8. Further, it can be understood that corner parts 9 of the package are also sealed.

Figure 3:
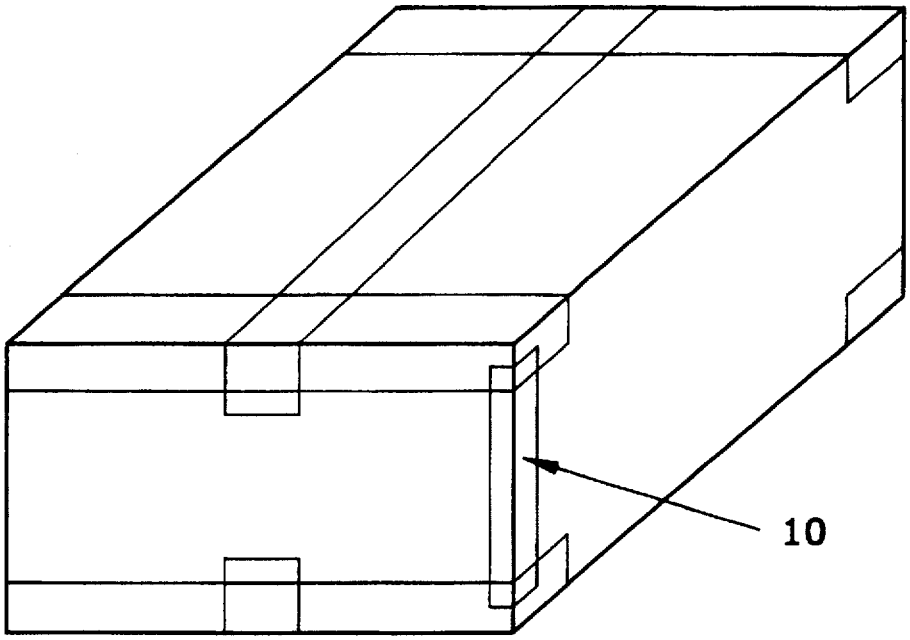
FIG. 3 is a perspective view illustrating an example of the sealed corrugated fiber board package according to the present invention.

FIG. 3 shows the end parts 10 of the corrugated fiber board in the mated part thereof at the side surfaces of the package, which are exposed to the outside and which are sealed. In this figure, each of the end parts 10 of the corrugated fiber board is completely sealed. However, a part thereof can be left to be unsealed so as to define a gas transmission adjusting ratio.

Figure 4:
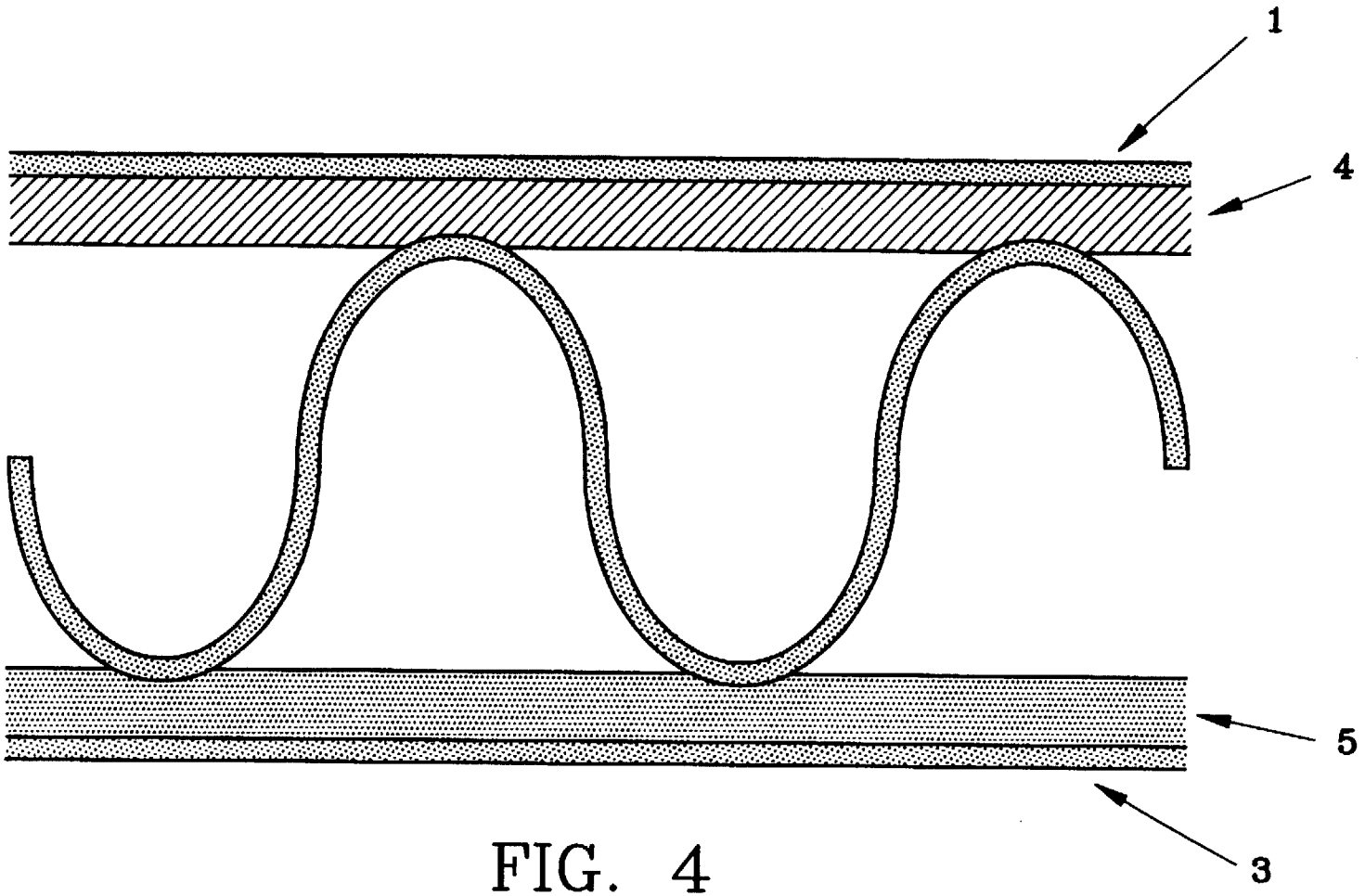
FIG. 4 is a cross sectional view illustrating a part of a wall of a corrugated fiber board package in a comparison example.

FIG. 4 shows the corrugated fiber board package as a comparative example in which the coating resin layer 4 is laid on the inside of the outer liner 1, and the coating resin layer 5 is laid on the corrugating medium side of the liner 3.

Figure 5:
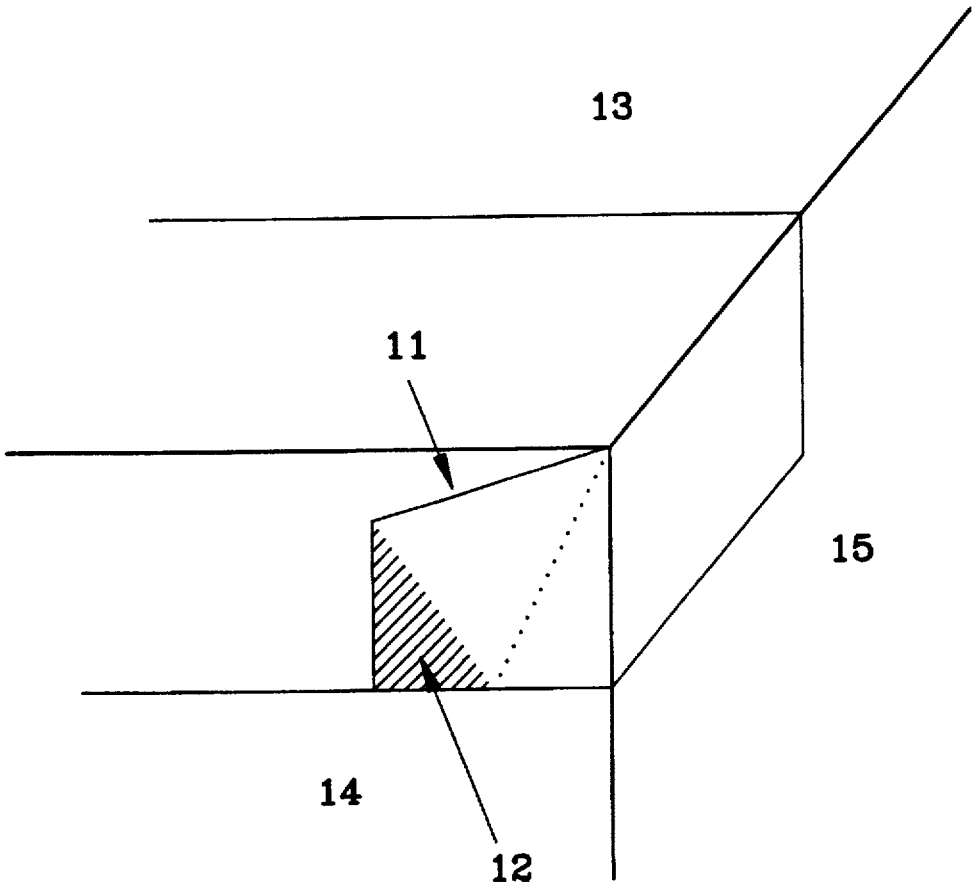
FIG. 5 is an explanatory view showing a sealed part of a corner of a package.

FIG. 5 shows the sealed part at one of the corners. The seal tape is sealed for sealing to surfaces 13, 14, and 15. At the corner of the package, the end part of the seal tape sealed to the surface 13, which is not sealed, is folded and sealed to the surface 14, excepting a part of the corner peripheral part, and thereafter, the end part of the seal tape projected from the surface 13 is folded and sealed to the surface 15. Further, the remaining parts thereof are sealed together to form a quadrilateral sealed piece 11, a part 12 which a sticking surface remains being left. This remaining part 12 is sealed to the surface 14 so as to fix the sealed piece 11. Thus, the corner is completely surrounded by the seal tape while the end part of the seal tape is fixed so that the seal tape does not form a protrusion.

In this embodiment, the seal tape sealed to the surface 13 had been explained. However, seal tapes sealed to the surfaces 14 and 15 are also similar, excepting that the triangular shape of the remaining part 12 slightly differs, and the sealing position of the sealed piece varies. The advantageous effect obtained thereby are unaltered.

Explanation will be made of evaluation for the gas and water-vapor permeabilities of several kinds of films and the corrugated fiber board used in the following embodiments, at a temperature of 27° C., and for the compression strength of the corrugated fiber board package.

(1) Gas-permeabilities of Film

In the measurement, a gas mixture permeability measuring device (LYSS GPM-200) using a commercially available gas chromatography as a detector was used. Carbon dioxide gas and air were fed toward the inflow side of a film at a mixing ratio of 1:4 under a normal pressure, and helium gas was used as carrier gas on the discharge side of the film so as to measure composition of the gas on the discharge side at every moment. Count numbers of gases were compensated by previously obtained detection curves so as to obtain permeating volumes at every time. Further, with the use of a least square method, the gradient was obtained from the measured points. Thus, in consideration with the thickness of the used film and the effective area of a transmission cell, the permeability coefficient $P_{CO_2}$ ($cm^3$(STP)cm/$cm^2$·s·cmHg) was calculated. The measurement was carried out in a condition in which the transmission cell and the chamber were held at a uniform temperature of 27° C.

(2) Water Vapor Transmission Rate

In the measurement, a commercially available water-vapor transmission rate tester (LYSSY L80-4000 type) was used, and the water-vapor transmission of a biaxialy stretched polyethylene terephthalate film having a thickness of 25 μm as a standard sample was previously measured with the use of a cup method. With the use of this method, the water-vapor transmission rate could be obtained with a unit of g/$m^2$·day, and the thus obtained water-vapor transmission rate of the coated liner.

(3) Gas-Transmission of Corrugated Fiber Board Package

After a corrugated fiber board package was sealed in an empty condition, the permeable characteristic was measured at a temperature of 27° C. In the case of carbon dioxide, the inside of the package was substituted by a gas mixture at a mixing ratio between nitrogen and carbon dioxide gas of 80:20, and thereafter, the time-dependent variation in the gas composition was measured by the gas chromatography so as to obtain a curve from which the permeability at a pressure differential of 0.2 atm was obtained. Further, the in the case of oxygen, the inside was completely substituted by nitrogen, and thereafter, time-dependent variation in the concentration of oxygen is obtained by a similar method. The unit of the thus obtained permeabilities is indicated by cc(STP)/hr (standard condition conversion). However, in consideration with the thickness of the coating resin layer and the effective surface area, excepting parts which are used for sealing to the end parts and the corner parts, the permeability coefficients $P_{CO_2}$ and $P_{O_2}$ $cm^3$(STP)cm/$cm^2$·s·cmHg were calculated.

Each of the above-mentioned measurements were repeated by three times, and the values to be measured was obtained by arithmetic average of the three time measurements.

(4) Compression Strength of Corrugated Fiber Board Package

In the measurement of compression strength, a commercially available compression strength tester (CTM-1-5000 type) was used. The measurements were carried out in conformity with JIS-0212. The compressing direction was set to a face-to-face direction, and the testing was carried out at a compression rate of 10 mm/min. A maximum compression load (kgf) was used as the compression strength of the corrugated fiber board package.

Each of the above-mentioned measurements were repeated by three times, and the values to be measured were obtained by arithmetic average of the three time measurements.

(5) Water-vapor transmission rate of Wrapping Paper coated with Synthetic Resin

In the measurement, a commercially available water-vapor transmission rate tester (LYSSY L80-4000 type) was used, and the water-vapor transmission of a biaxially stretched polyethylene terephthalate film having a thickness of 25 μm as a standard sample was previously measured with the use of a cup method. With the use of this method, the water-vapor transmission rate could be obtained with a unit of g/$m^2$·day, and accordingly, in this case, the measured value was converted into a value having a unit of $cm^3$(STP) cm/$cm^2$·s·cmHg with the use of the thickness of the film and a waver-vapor pressure (2.67 cmHg) at a temperature of 27° C. The thus converted value was used as an index of the water-vapor transmission rate of the coated paper. For example, if the coated paper has a thickness of 20 μm and a permeability of 50 g/m²·day, the conversion gives a permeability coefficient of $54\times10^{-9}$ cm³(STP)cm/cm²·s·cmHg.

With the use of data relating the permeabilities of the resin coated paper which are measured by the above-mentioned methods, the permeabilities of an actual package can be estimated. For example, with a corrugated fiber board package (having a length L=288 mm, a width W=190 mm and a height H=115 mm) in embodiment 1 which will be explained later, if the effective surface area excepting a part which are used for sealing the end parts and corner parts, is set to 1,650 cm² and the pressure difference of carbon dioxide gas and oxygen between the inside and outside of the package is set to 0.2 atm, in the case of using resin coated paper relating to the embodiment 1 of the present invention, the permeability characteristics of the package could be calculated so as to obtain $P_{CO_2}$=86 cc (STP)/hr, $P_{CO_2}/P_{O_2}$=3.7, and $P_{H_{2+sc}\ O}$=5 g/day. Meanwhile, after this package was sealed in an empty condition, the permeability characteristics were actually measured at a temperature of 27° C. In the case of carbon dioxide, after the inside of the package was substituted by a gas mixture of nitrogen and carbon dioxide gas, having a ratio (volume ratio) of 80:20, the permeability at a differential pressure of 0.2 atm were obtained from a curve which can be obtained by measuring the time-dependent variation in the composition of gas with the use of the gas chromatography. Further in the case of oxygen, after the inside of the package was substituted completely by nitrogen, a time-dependent variation curve of the concentration of oxygen was measured in similar method, and the permeability at a differential pressure of 0.2 atm were obtained. Further, as to water-vapor, a package charged with a saturated salt solution which can be sustained at a relative humidity (RH) of 97% at a temperature of 27° C., was disposed in a chamber having a RH of 25% at a temperature of 27° C. so as to measure the time-dependent variation in the weight thereof which is thereafter converted into a difference in concentration of water-vapor so as to obtain the permeability. The thus obtained measured values precisely coincided with the afore-mentioned calculated values with a maximum difference of 10%. Thus it has been confirmed that the permeability of a package can be precisely estimated from the permeability of a resin coated film to be used for the package.

(6) Permeability after Low Temperature Folding

The folding-proof process ability of resin coated paper were measured with the use of a test piece having a size of 100×100 mm, the resin-coated surface thereof facing the outside, in conformity with the evaluation method for 6.5 cold-proof, JISZ-1514 "Polyethylene Work Paper". After the test piece was folded in two directions orthogonal to each other, the gas permeabilities and the water-vapor transmission rates were measured.

Each of the above-mentioned measurements were repeated by three times, and a value to be measured are obtained by arithmetic average of three time measurements.

COMPARISON TEST 1

Embodiment 1

A corrugated fiber board package shown in FIG. 1 was prepared.

A blend of low density polyethylene LDPE polymerized by a high pressure process and the so-called ultra low density polyethylene LLDPE copolymerized from ethylene and butene-1, having a weight ratio of 60:40 was extruded by resin film thickness of 20 μm and was laminated over the outer surface of a corrugated fiber board liner paper material having a base weight of 220 g/m². As the conditions, a temperature of resin directly below a die in a range of 320° to 325° C., a lamination rate of 100 m/min., and a liner surface corona process of 5 Kw were used. With the use of the resin coated liner as the outer surface, 180 g/m² base weight of a corrugating medium which were corrugated by a corrugator, was sealed at first with the use of water base adhesive and then 280 g/m² base weight of an inner liner coated at its inner surface with LDPE having a film thickness of 30 μm was then sealed so as to obtain a corrugated fiber board. The corrugated fiber board was subjected to a usual punch-out process, and then joint flaps are joined with the use of hot-melt adhesive so as to prepare an A-1 type corrugated fiber board package (having a length L=288 mm, a width=190 mm and a height H=115 mm) specified by JIS Z 1507. The resin coated outer liner had a $P_{CO_2}$ of $15.0\times10^{-10}$ cm³(STP)cm/cm²·s·cmHg, and the resin coated inner liner had a water-vapor transmission rate of 32.5 g/m²·day.

COMPARISON EXAMPLE 1

A corrugated fiber board package in which the structure of the outer liner was identical with that of the embodiment 1 while the inner liner was not coated with resin, was used.

COMPARISON EXAMPLE 2

A corrugated fiber board package in which the outer liner was not coated with resin while the structure of the inner liner is identical with that of the embodiment 1.

COMPARISON EXAMPLE 3

A conventional corrugated fiber board package was directly used, with no coating resin layers.

COMPARISON EXAMPLE 4

A corrugated fiber board package shown in FIG. 4 was prepared. The coating resin layers on the outer and inner layers are identical with those in the embodiment 1.

TEST METHOD

Each of the above-mentioned five kinds of the corrugated fiber board packages were packed therein with 2 kg of kabosus [Japanese lime] (variety: Ohita No. 1) harvested in the middle of September after they were previously treated and was completely sealed by using an adhesive tape composed of biaxially stretched polypropyrene as a base material and having a width of 40 mm, as shown in FIG. 3. Five packages for each kind were stored in an atmosphere at 20° C. and at 65% RH. After a storage period of about one month, the concentrations of carbon dioxide gas and oxygen in the packages were measured, and the compression strengths thereof were measured by the above-mentioned method. Then the packages were unsealed, and the qualities of kabosus were evaluated so as to obtain (1) satisfactory proportion (%) of conforming articles in which their green color was held and their pericarps were supple, (2) dissatisfactory proportion (%) of non-conforming articles, that is, A: yellowing, B: pedicel or stalk falling out; C: withering; and D: other defects such as molding; and (3) weight reduction ratio (%) with respect to the total initial weight.

Table 1 summarizes gas compositions in the corrugated fiber board packages, compression strengths thereof (ratio (%) with respect to the compression strengths of the conventional corrugated fiber board package before storage which is set to 100), and the results of the storage tests for kabosus.

TABLE 1

| | Gas Composition in Corrugated Fiber Board Packages (%) | | Maximum Compression Weight in (%) | Storage Test Results of Corrugated Fiber Board | | | |
|---|---|---|---|---|---|---|---|
| | | | | Acceptable Proportion | Unacceptable Proportion | | Weight Reduction Ratio |
| | $O_2$ | $CO_2$ | | | | | |
| Embodiment 1 | 9.5 | 4.8 | 87.7 | 98 | B: | 2 | 2.3 |
| Comparison Example 1 | 10.1 | 4.5 | 17.3 | 75 | B: | 4 | 8.1 |
| | | | | | C: | 21 | |
| Comparison Example 2 | 20.3 | 0.8 | 85.2 | 0 | A: | 85 | 3.1 |
| | | | | | B: | 10 | |
| | | | | | C: | 5 | |
| Comparison Example 3 | 20.9 | 0 | 59.8 | 0 | A: | 23 | 20.6 |
| | | | | | B: | 6 | |
| | | | | | C: | 70 | |
| | | | | | D: | 1 | |
| Comparison Example 4 | 19.8 | 1.6 | 42.6 | 15 | A: | 60 | 6.9 |
| | | | | | B: | 7 | |
| | | | | | C: | 15 | |
| | | | | | D: | 3 | |

Note: A, B, C, D in column of "Unacceptable Proportion" denote as follows: A: Yellowing; B: Pedicel Falling Out: C: Withering and D: Other defects such as molding.

As to the corrugated fiber board package in which the outer liner is alone coated with resin in the comparison example 1, since the gas exchange between the inside and outside of the package was controlled through the surface of the outer liner, the gas composition in the package was coincident with the CA storage condition of kabosus so that the green color of the pericarp was held. However, since the transpired water-vapor from the fruits shifted into the liner and the corrugating medium, the compression strength of the package becomes greatly lower. Further, the weights of the fruits were reduced accordingly, and therefore, withering was remarkable.

As to the corrugated fiber board package in which the inner liner is alone coated with resin in the comparison example 2, transpired water-vapor did not shift so that the compression strength of the package was held, and the reduction of the weights of the fruits were restrained. However, the gas exchange were freely made between the inside and outside of the package through the corrugating medium and the outer liner which is not coated with resin, at the end surfaces of the corrugated fiber board which are opened to the inside of the package, as mentioned above, and accordingly, the gas composition in the package came to be substantially equal to that of the atmosphere. Thus, yellowing and pedicel falling-off were remarkable.

As to the conventional corrugated fiber board package which is not coated with resin in comparison example 3, the reduction of the weight was excessive, and a major part of the fruits withered. Further, since the respiration could not be controlled, a large number of fruits yellowed.

As to the corrugated fiber board package in the comparison example 4, since gas freely passed through the outer liner from the abutting parts of the flaps of the outer liner, the respiration could not be controlled. Accordingly, a large number of fruits yellowed. Further, since the resin layer 5 of the inner liner was positioned outside so as to be exposed to the inside of the package, water-vapor transpired from the fruits was absorbed so that the strength was lowered, and the transpiration of water-vapor from the fruits was promoted.

On the contrary, as to the corrugated fiber board package in which both inner and outer liners are resin coated, since the respiration was restrained due to the simple CA effect in the embodiment 1, there could be obtained a satisfactory keeping quality in which the green color of the pericarp was held, and the weight was not decreased substantially. Further, the strength of the package was not substantially lowered from the initial strength. That is, a serviceable effect could be obtained.

COMPARISON TEST 2

Embodiment 2

A blend of low density polyethylene LDPE (a density $\rho$=0.918) and ultra low density polyethylene LLDPE ($\rho$=0.905), having weight ratio of 40:60 was extruded by a resin film thickness of 25 μm and was laminated over the surface of a corrugated fiber board liner paper material having a base weight of 280 g/m$^2$. With the use of the resin coated liner as the outer liner on the outer surface side, 180 g/m$^2$ base weight of a corrugating medium, was sealed at first with the use of water base adhesive, together with 280 g/m$^2$ base weight of an inner liner coated at its inner surface with LDPE ($\rho$=0.918) having a film thickness of 25 μm so as to obtain a corrugated fiber board. The corrugated fiber board was subjected to a usual punch-out process and an assembly process so as to prepare an A-1 type corrugated fiber board package (having a length L=288 mm, a width=190 mm and a height H=115 mm). The resin coated outer liner had a $P_{CO_2}$ of $13.5\times10^{-10}$ cm$^3$(STP)cm/cm$^2$·s·cmHg, and the resin coated inner liner had a water-vapor transmission rate of 39.0 (g/m$^2$·day).

The above-mentioned corrugated fiber board package packed therein with 2 kg of green plums (variety: Nankou-Ume) which had been pre-cooled for 8 hours in a pre-cooler at a temperature of 10° C. after harvest, was sealed with the use of an adhesive tape having a width of 40 mm and composed of biaxially stretched polypropyrene as a base material, as shown in FIG. 2, excepting the exposed end parts of the corrugated fiber board in the mated parts thereof at the side surfaces of the package, which were used as gas transmission adjusting regions.

COMPARISON EXAMPLE 5

A corrugated fiber board package similar to that in the embodiment 2, excepting that the seal tape is sealed only to the abutting parts of the corrugated fiber board in the bottom portion and the cover portion of the package so as to obtain I-like shape sealing, was prepared.

COMPARISON EXAMPLE 6

A corrugated fiber board package which is similar to that in the embodiment 2, excepting that the corner parts 9 are not sealed, was prepared.

COMPARISON EXAMPLE 7

A conventional corrugated fiber board which is not coated with resin was sealed as shown in FIG. 2.

TEST METHOD 10 packages in each kind were prepared, and were stored in an atmosphere at 20° C. and at 65% RH. The packages were unsealed five days after harvest. The green plums were evaluated as to (1) yellowing, (2) withering and (3) weight reduction ratio (%). The items (1) and (2) were given by a ratio (%) of those which indicate variation among all the plums. The item (3) was given by a reduction ratio (%) with respect to the initial total weight. The results of the test shown in Table 2.

TABLE 2

| | Gas Permeabilities in Corrugated Fiber Board Packages $PCO_2/PO_2$ | Storage Test Results of Corrugated Fiber Board | | |
|---|---|---|---|---|
| | | Yellowing | Withering | Weight Reduction Ratio |
| Embodiment 2 | 2.2 | 2 | 0 | 1.6 |
| Comparison Example 5 | 0 | 53 | 21 | 7.2 |
| Comparison Example 6 | 1.2 | 45 | 14 | 5.8 |
| Comparison Example 7 | 0.9 | 31 | 69 | 7.1 |

With the sealing made in the comparison examples 5 or 6, since gas passes through the superposed flap parts and the corner parts of the corrugated fiber board package, and accordingly, in particular, oxygen is freely fed, the gas permeability coefficient ratio is low so that the fruits in a number nearly equal to one half of the total number yellowed. Further, although a decrease in weight caused by transpiration was restrained in comparison with the packages in the comparison example 7 which was not coated with resin, about twenty percent of the fruits withered.

Meanwhile, in the method in the embodiment 2, the exchange of gas between the inside and outside of the package were controlled by the surfaces of the package and the exposed end parts of the corrugated fiber board in the mated parts thereof at the side surfaces of the package, which has been unsealed so as to form the gas transmission adjusting regions, and accordingly, a large volume of carbon dioxide gas was discharged while an appropriate volume of oxygen was fed, due to a high permeability coefficient ratio. Thus, the yellowing was relatively restrained even five days after the harvest, and further, no browning occurred while a decrease in weight was extremely small, that is, a well balanced keeping quality was ensured.

Comparison example 6, however, is acceptable as an embodiment of the present invention because its results are better than those of comparison examples 5 and 7.

COMPARISON TEST 3

Embodiment 3

A blend of low density polyethylene LDPE ($\rho$=0.918) and ultra low density polyethylene LLDPE ($\rho$=0.905), having weight ratio of 60:40 was extruded by a resin film thickness of 20 μm and was laminated over the outer surface of a corrugated fiber board liner paper material having a base weight of 220 g/m$^2$. With the use of the resin coated liner as the outer liner on the outer surface side, 160 g/m$^2$ base weight of a corrugating medium was sealed with the use of water base adhesive, together with 220 g/m$^2$ base weight of an inner liner coated at its inner surface with LDPE ($\rho$=0.915) having a film thickness of 30 μm so as to obtain a corrugated fiber board. The corrugated fiber board was subjected to a usual punch-out process and an assembly process so as to prepare an A-1 type corrugated fiber board package (having a length L=400 mm, a width=140 mm and a height H=100 mm). The resin coated outer liner had a $P_{CO_2}$ of $16\times10^{-10}$ cm$^3$(STP)cm/cm$^2$·s·cmHg, and the resin coated inner liner had a water-vapor transmission of 37.50 g/m$^2$·day.

COMPARISON EXAMPLE 8

A corrugated fiber board package similar to that in the embodiment 3 was prepared, having 10 μm film thickness of the resin LDPE ($\rho$=0.915) with which the inner layer was coated. The water-vapor transmission rate of the resin coated liner was 112.5 g/m$^2$·day.

COMPARISON EXAMPLE 9

A conventional corrugated fiber board package was directly used, having no coating resin layer. The base weights of the liners and the size of the package were the same as those in the embodiment 3.

TEST METHOD 500 g of spinach which has been pre-cooled in a vacuum pre-cooler at 5° C. after the harvest was packed in each of the above-mentioned three kinds of the corrugated fiber board packages which were completely sealed by an adhesive tape having a width of 40 mm and composed of biaxially stretched polypropyrene as a base material, as shown in FIG. 3. Five packages were prepared for each of the above-mentioned kinds, and were held in an atmosphere at 20° C. and at 60% RH. After six storage days, the packages were unsealed, and the reduction ratio (%) thereof were measured, with respect to the initial total weight thereof as a reference value.

RESULTS

As to the conventional corrugated fiber board package in the comparison example 9, the weight reduction ratio was 31.5% which is remarkably large, and the spinach completely withered. Further, as to the corrugated fiber board package in the comparison example 8 having the inner liner with the thin coating resin layer, the restrain to the weight reduction was insufficient since the water-vapor transmission rate was great, accordingly, the weight reduction ratio after six days was 14.4%, that is, the commercial value was lost. Further, the maximum compression strength of the package has a tendency to decrease down to 35%.

On the contrary, as to the corrugated fiber board package in the embodiment 3, the weight reduction ratio, six days after the harvest, was small, that is 2.5%, and substantially no withering was found. Further, since the $P_{CO_2}/P_{O_2}$ of the outer liner was moderately large, withering of the leaves, sliming and bad smell were not found, that is, a sufficient fresh-keep effect could be obtained. Further, the lowering of the compression strength of the package was small, and was satisfactory.

COMPARISON TEST 4

Embodiment 4

A blend of low density polyethylene LDPE (ρ=0.918) and ultra low density polyethylene LLDPE (ρ=0.905), having weight ratio of 80:20 was extruded by a resin film thickness of 25 μm and was laminated over the outer surface of a corrugated fiber board liner paper material having a base weight of 280 g/m$^2$. The gas permeable characteristics of the resin coated liner material were evaluated, and then with the use of the resin coated surface as the outer liner on the outer surface side, 180 g/m$^2$ base weight of a corrugating medium was sealed with the use of water base adhesive, together with 280 g/m$^2$ base weight of an inner liner coated at its inner surface with LDPE (ρ=0.918) having a film thickness of 30 μm so as to obtain a corrugated fiber board. The corrugated fiber board was subjected to a usual punch-out process and an assembly process so as to prepare an A-1 type corrugated fiber board package (having a length L=288 mm, a width=190 mm and a height H=115 mm). The resin coated inner liner had a water-vapor transmission rate of 32.5 g/m$^2$·day.

their pericarps were supple, (2) percent defective (%) of nonconformity articles, that is, A: yellowing, B: pitting, C: browning, and D: molding and the like, and further (3) weight reduction rate (%) with respect to the total initial weight as a reference (Storage Zone I). Further, the packages in which the conformity articles were stored, were again sealed as shown in FIG. 2, while the exposed end parts of the corrugated fiber board at the side surfaces of the package are left to be unsealed so as to define gas transmission adjusting regions, on assumption of the physical distribution for the packages during use. After two storage weeks at 20° C. and at 65% RH, the packages were again unsealed, and the quality of the article were evaluated (Storage Zone II).

Table 3 summarizes the permeable characteristics of the resin coated paper materials and the corrugated fiber board packages, and the results of the storage test for kabosus using these corrugated fiber board packages.

TABLE 3

| | Gas | Gas Permeabilities in Corrugated Fiber Board Packages $PCO_2/PO_2$ | | Storage Test Results of Corrugated Fiber Board | | | | | | | |
|---|---|---|---|---|---|---|---|---|---|---|---|
| | | For Storage | Distribution | Storage Zone I | | | | Storage Zone II | | | |
| | Permeability* in Outer Liner $PCO_2$ | Purpose (Storage Zone 1) | Purpose (Storage Zone II) | Acceptable Proportion | Unacceptable Proportion** | | Weight Reduction Ratio | Acceptable Proportion | Unacceptable Proportion** | | Weight Reduction Ratio |
| Embodiment 4 | 10.5 | 3.6 | 2.4 | 98 | A: | 2 | 0.8 | 95 | A:<br>B: | 4<br>1 | 2.0 |
| Comparison Example 10 | 98.0 | 1.3 | 1.0 | 22 | A:<br>D: | 73<br>5 | 0.9 | 8 | A:<br>C:<br>D: | 85<br>5<br>2 | 2.3 |
| Comparison Example 11 | 0.21 | 4.1 | 3.1 | 18 | B:<br>C:<br>D: | 25<br>49<br>8 | 1.5 | 5 | B:<br>C:<br>D: | 28<br>60<br>7 | 3.8 |

*$PCO_2 \times 10^{10} cm^3(STP)cm/cm^2 \cdot s \cdot cmHg$
**A: Yellowing; B: Pitting; C: Browning; D: Other defects such as molding (%).

COMPARISON EXAMPLE 10

A corrugated fiber board package was prepared, similar to the embodiment 4, excepting that poly 4-methylpentene 1:TPX were used instead of LDPE and LLDPE blend.

COMPARISON EXAMPLE 11

A corrugated fiber board package was prepared, similar to the embodiment 4, excepting that polyethylene terephthalate was used, instead of LDPE and LLDPE blend.

TEST METHOD

Each of the above-mentioned three kinds of the corrugated fiber board packages were packed therein with 2 kg of kabosus (variety: Ohita No. 1) harvested in the middle of September after they were previously treated, and was completely sealed by using an adhesive tape composed of biaxially stretched polypropyrene as a bass material and having a width of 40 mm, as shown in FIG. 3. Five packages for each kind were stored in an atmosphere at 5° C. and at 60%. After a storage period of about two month; the packages were unsealed, and the qualities of kabosus were evaluated so as to obtain (1) an acceptable proportion (%) of conforming articles in which their green color was held, and In the case of using poly 4-methylpentene 1 having a large carbon dioxide permeability coefficient in the comparison example 10 as coating, even though the resin itself has a large permeability coefficient ratio, the permeability coefficient ratio of the package would be relatively small so that the permeability coefficient of oxygen would be relative large even if the package was sealed as shown in FIG. 3 (storage zone 1) since cracking would occur during fabrication of the corrugated fiber board into a package. Upon reflection with the permeable characteristics, the respiration was not substantially be restrained under the storage test with the use of this package, about 70% of the fruits yellowed after two storage months. Further, if the exposed end parts of the corrugated fiber board in the mated parts thereof at the side is surfaces of the package were left to be unsealed so as to define the gas transmission adjusting regions for physical distribution, the characteristic ratio of the package further increased so that a major part of the fruits yellowed after two storage weeks at an ordinary temperature.

The coating of polyethylene terephthalate has a carbon dioxide permeability coefficient which was remarkably small, as is clear from the comparison example 11, and accordingly, the concentration of carbon dioxide gas in the corrugated fiber board was extremely large so as to cause anaerobic respiration, resulting in the presence of many gas damaged fruits.

Meanwhile, the coating of the blend of LDPE and ultra low density LLDPE in the embodiment 4 caused moderate supply of oxygen due to a high carbon dioxide permeability coefficient and a high permeability coefficient ratio of the package, and accordingly, the yellowing was relatively restrained even after two storage months at a low temperature, and further, the browning was less while the weight reduction was extremely small, that is, a satisfactory keeping quality was ensured. During the ordinary temperature storage which was set on assumption of actual distribution thereof, occurrence of browning due to an increases in respiration degree was deeply concerned. However, since the exposed end parts of the corrugated fiber board in the mated parts thereof at the side surfaces of the package were left to be unsealed so as to define the gas transmission adjusting regions, as shown in FIG. 2, the gas composition is the package was suitable for the preservation of kabosus, and accordingly, there were found substantially no gas damaged fruits.

Next, explanation will be made of sealing methods in embodiment forms.

Embodiment 5

A blend of low density polyethylene LDPE (ρ=0.918) and ultra low density polyethylene LLDPE (ρ=0.905), having weight ratio of 60:40, was extruded by a resin film thickness of 20 μm and was laminated over the outer surface of corrugate fiber board liner paper material having a base weight of 220 g/m$^2$. With the use of the resin coated surface as the outer liner on the outer surface side, 160 g/m$^2$ base weight of a corrugating medium was adhered with the use of water base adhesive, together with 220 g/m$^2$ base weight of an inner liner coated at its inner surface with LDPE (ρ=0.918) having a film thickness of 30 μm so as to obtain a corrugated fiber board. The corrugated fiber board was subjected to a usual punch-out process and an assembly process so as to prepare an A-1 type corrugated fiber board package (having a length L=400 mm, a width=140 mm and a height H=100 mm). The resin coated outer liner has a $P_{CO_2}$ of $16.0\times10^{-10}$ cm$^3$(STP)cm/cm$^2$·s·cmHg, and the resin coated inner liner had a water-vapor transmission rate of 37.5 g/m$^2$·day.

The above-mentioned corrugated fiber board package packed therein with 500 g of leeks which had been pre-cooled for 2 hours in a vacuum pre-cooler at a temperature of 5° C. after harvest, was completely sealed with the use of an adhesive tape having a width of 40 mm and composed of biaxially stretched polypropyrene as a base material, as shown in FIG. 3, and the corner parts were sealed as shown in FIG. 5.

COMPARISON EXAMPLE 12

A package similar to that in the embodiment 1 was prepared, excepting that the abutting parts of the corrugated fiber board in the bottom and cover portions of the package were sealed by adhering an adhesive tape in an I-shape.

COMPARISON EXAMPLE 13

A package similar to that in the embodiment 5 was prepared excepting that the corner parts 9 were not sealed.

COMPARISON EXAMPLE 14

A conventional package having no resin coated was sealed as shown in FIG. 3.

TEST METHOD

Five packages were prepared for each kind and were stored in an atmosphere at a 20° C. and at 60% RH. After six storage days, they were unsealed and then the lees were evaluated concerning (1) yellowing and sliming, (2) withering and (3) weight reduction ratio. (1) and (2) were indicated by proportions (%) of those which exhibited variation, among the total number thereof, and (3) was indicated by a reduction rate (%) with respect to the initial total weight. The results were shown in Table 4.

TABLE 4

| | Gas Composition in | Storage Test Results of Corrugated Fiber Board | | |
|---|---|---|---|---|
| | Corrugated Fiber Board Packages $PCO_2/PO_2$ | Yellowing and Sliming | Withering | Weight Reduction Ratio |
| Embodiment 5 | 2.2 | 5 | 0 | 1.3 |
| Comparison Example 12 | 1.0 | 62 | 25 | 8.1 |
| Comparison Example 13 | 1.2 | 55 | 18 | 6.0 |
| Comparison Example 14 | 0.9 | 40 | 60 | 19.3 |

As to the sealing methods in the comparison examples 12 and 13, since gas freely passed through the superposed flap parts and the corner parts of the corrugated fiber board, and in particular oxygen was freely fed, the gas permeability coefficient ratio of the package was small, and accordingly, yellowing and sliming were greatly found. Further, although a reduction in weight due to transpiration was restrained in comparison with that of the comparison example 14 in which no resin was coated, about 20% of the leeks withered.

Meanwhile, as to the sealing method in the embodiment 5, since the gas exchange between the outside and the inside of the package was controlled by the surface of the outer liner, a large volume of carbon dioxide gas was discharged while a moderate volume of oxygen was fed, and accordingly, yellowing was relatively restrained even six days after the harvest. Further, a well balanced keeping quality with no bad smell and extremely less reduction in weight was ensured.

COMPARISON TEST 2

Embodiment 6

A blend of low density polyethylene LDPE (ρ=0.918) and ultra low density polyethylene LLDPE (ρ=0.905), having weight ratio of 80:20, was extruded by resin film thickness of 30 μm and was laminated over the outer surface of a corrugated fiber board liner paper material having a bass weight of 280 g/m$^2$. With the use of the resin coated surface as the outer liner on the outer surface side, 180 g/m$^2$ base weight of a corrugating medium was sealed with the use of water base adhesive, together with 280 g/m$^2$ base weight of an inner liner coated at its inner surface with LDPE (ρ=0.918) having a film thickness of 30 μm so as to obtain a corrugate fiber board. The corrugated fiber board was subjected to a usual punch-out process and an assembly process so as to prepare an A-1 type corrugated fiber board package (having a length L=288 mm, a width=190 mm and a height H=115 mm). The resin coated outer liner has a $P_{CO_2}$ of $7.5\times10^{-10}$ cm$^3$(STP)cm/cm$^2$·s·cmHg, and the resin coated inner liner had a water-vapor transmission of 37.5 g/m$^2$·day.

The above-mentioned corrugated fiber board was packed therein with 2 kg of robust kabosus (variety: Ohita No. 1)

which were stored being packed and sealed in LDPE bags by two months after they were harvested in the middle of September and then pretreated. Each of the exposed end parts of the corrugated fiber board in the mated parts thereof at the side surface of the package were then sealed by an adhesive tape having a width of 40 mm and composed of biaxially oriented polypropyrene as a base material, leaving a part having a length of 50 mm to be unsealed so as to define an gas transmission adjusting region as shown in FIG. 2. The corner parts were sealed as shown in FIG. 5.

Embodiment 7

A corrugated fiber board package similar to that in the embodiment 6 was prepared, excepting that the exposed end parts of the corrugated fiber board in the mated parts thereof were completely sealed as shown in FIG. 3.

Embodiment 8

A corrugated fiber board package, similar to that in the embodiment 6 was prepared, excepting that it was sealed as shown in FIG. 2, without the exposed end parts of the corrugated fiber board being not sealed.

TEST METHOD

Ten packages prepared for each kind were stored in an atmosphere at 20° C. and at 65% RH for two weeks, and were then unsealed. The quality of the kabosus were evaluated so as to obtain (1) a proportion (%) of conforming or acceptable kabosus having supple pericarps with sufficiently held green color, (2) proportions (%) of A: yellowing, B: pitting, C: browning, D: molding and the like, and (3); a weight reduction rate with respect to the initial total weight as a reference.

Table 5 summarizes the gas permeabilities of the respective, corrugated fiber boards, the gas compositions in the packages, and results of the storage tests for kabosus.

package in the embodiment 7 in which the exposed end parts are completely sealed, the concentration of oxygen in the package becomes lower, and accordingly, pitting and browning occur due to anaerobic respiration. On the contrary, with the package having the exposed end part which are not sealed as that of the embodiment 8, the concentration of oxygen in the corrugated fiber board package becomes higher so that the fruits yellowed.

Meanwhile, as to the sealing method in the embodiment 6, the respiration of kabosus in the package well balanced with the gas-exchange 50 mm width which were opened for the gas transmission adjusting regions, and accordingly, the gas composition in the package was suitable for the storage of kabosus so that substantially no gas damaged fruits and yellowing fruits were found.

As mentioned above, it is effective that the opened end parts of the corrugated fiber board at the side surfaces of the package are sealed, excepting the gas transmission adjusting regions.

Next, explanation will be made of embodiments of the resin coated wrapping paper.

COMPARISON TEST 5

Embodiment 9

A blend of low density polyethylene LDPE (ρ=0.918) polymerized by a high pressure process and the so-called ultra low density polyethylene LLDPE (ρ=0.905) copolymerized from ethylene and butene-1, having a weight ratio of 60:40 were extruded by a resin film thickness of 15 μm at 13.5 g/m$^2$ obtained through weight conversion per unit area, and was laminated with 280 g/m$^2$ of a corrugated fiber board line paper material, the following conditions were used: a resin temperature directly below dies of 320° to 325° C., a laminate rate of 100 m/min., and a corona process for a liner surface of lower than 5 kw.

COMPARISON EXAMPLE 15

LDPE (density ρ=0.918) was used for comparison.

TABLE 5

| | Permeabilities in Corrugated Fiber Board Packages | Gas Composition in Corrugated Fiber Board Packages (%) | | Storage Test Results of Corrugated Fiber Board: Acceptable | Unacceptable* | | Weight Reduction |
|---|---|---|---|---|---|---|---|
| | $PCO_2/PO_2$ | $O_2$ | $CO_2$ | Proportion | Proportion | | Ratio |
| Comparison Example 6 | 2.0 | 8.2 | 4.5 | 93 | A: | 7 | 1.8 |
| Comparison Example 7 | 2.4 | 2.7 | 15.6 | 53 | B:<br>C:<br>D: | 18<br>24<br>5 | 1.4 |
| Comparison Example 8 | 1.8 | 13.6 | 2.1 | 77 | A: | 23 | 2.0 |

*A: Yellowing; B: Pitting; C: Browning; D: Other defects such as molding.

It was found that all of the embodiments 6, 7 and 8 gave such a result that the carbon dioxide permeability coefficient of the outer liner, the water-vapor transmission rate of the inner liner and the carbon dioxide and oxygen permeability coefficient ratio of the package fall in the ranges specified by the present invention, but the gas compositions in the packages differ from each other since the sealing methods for the exposed end parts of the corrugated fiber board in the mated parts thereof at the side surfaces of the packages differ from each other. That is, if crops having a large degree of respiration, such as kabosus in storage, are packed in the

COMPARISON EXAMPLE 16

Poly 4-methylpentene 1: TPX was used.

COMPARISON EXAMPLE 17

Polyethylene terephthalate: PET was used.

Each of the above-mentioned materials in the comparison examples was extruded and laminated in conformity with the conditions as mentioned above, so as to have a resin film thickness of 15 μm. The thus obtained resin coated liner materials were evaluated concerning the permeability characteristics for gas and water-vapor with the use of the above-mentioned methods. Further, with the use of the resin coated liner as the outer surface, the corrugating process was at first carried out by a corrugator with the use of a water base bond, and then were laminated successively with 180 $g/m^2$ base weight of a canner corrugating medium, and 280 $g/m^2$ base weight of a liner coated at its inner surface with LDPE (density ρ=0.918) by a film thickness of 20 μm so as to obtain a corrugated fiber board. The corrugated fiber board were subjected to an usual punch-out, and then joint flaps were joined together with the use of hot-melt adhesive so as to prepare A-1 type corrugated fiber board package (Length L=288 mm, width W=190 mm and height H=115 mm) as specified in JIS Z1507.

In addition to the above-mentioned kinds of the corrugated fiber board packages, a conventional corrugated fiber board package (comparison example 18) was prepared for comparison. Each of the packages of five kinds in total, was packed with 2 kg of green plums (variety: Nankou Ume) which were pre-cooled for 8 hours in pre-cooler at 10° C. after the harvest, and thereafter, the upper and lower flap abutting parts and the lap parts including the corner parts of the package were sealed by an adhesive tape having a width of 40 mm and composed of biaxially stretched seal tape in an H-like shape. Further, the end parts of the joint flaps were sealed so as to completely seal the package. Ten packages were prepared for each kind, and were stored in an atmosphere at 20° C. and at 65% RH. Of 10 packages for each kind, 5 packages were unsealed three days after the harvests. The green plums were evaluated concerning (1) yellowing, (2)browning and softening and (3) weight reduction ratio. (1) and (2) were indicated by proportions (%) of plums whose pericarps appreciably varies, and (3) was indicated by a reduction (%) with respect to the initial total weight as a reference. The results are shown in Table 6.

after the harvest, and even 70% thereof yellowed six days after the harvest. Although this tendency was effective for the prevention of weight reduction caused by transpiration in comparison with the comparison example 4 in which no resin was coated, it was substantially not effective for the prevention of yellowing. As clear from the comparison example 3, with the coating of polyethylene terephthalate, the carbon dioxide permeability coefficient was extremely small while $P_{H_{2+sc}O}$ was remarkably large. Although craze-like micro cracking occurred through a low temperature folding process so that the permeability characteristics were slightly changed, film breakage did not occur. In this case, since the concentration carbon dioxide in the corrugated fiber board package was remarkably high, causing anaerobic respiration, the pericarps of the plums frequently yellowed three days after harvest, and a substantial part thereof were gas-damaged six days after the harvest. Further, on reflection of the large water-vapor transmission rate, a large weight reduction was exhibited. Further, as to the coating made of low density polyethylene (LDPE) produced by a high pressure method in the comparison example 15, as conventionally used, it is difficult to practically obtain an effective $P_{CO_2}$ and a $P_{CO_2}/P_{O_2}$ ratio, and further, variation in permeability caused by craze-like cracking due to a low temperature folding process was slightly found, the plums were slightly browned three days after the harvest, and there was a tendency of further increasing the browning six days after the harvest. Then, the fruits which were evaluated three days after the harvest were left as they were at a room temperature for further three days, a several number of the fruits which seemed to be robust browned. From this fact, it has been found that affection by respiration disorder was still serious.

Meanwhile, the coating made of the blend of LDPE and ultra low density LLDPE in the embodiment 9 allows suitable oxygen supply in accordance with a high carbon

TABLE 6

| | Gas Permeability in Resin Coated Paper* | | | | | | Three Days After Harvest | | | Seven Days After Harvest | | |
|---|---|---|---|---|---|---|---|---|---|---|---|---|
| | A. Without Low Temperature Folding Process | | | B. Without Low Temperature Folding Process | | | | | | | | |
| | $PCO_2$ | $PCO_2/PO_2$ | $PH_2O$ | $PCO_2$ | $PCO_2/PO_2$ | $PH_2O$ | Yellowing | Browning | Weight Reduction Ratio | Yellowing | Browning | Weight Reduction Ratio |
| Embodiment 9 | 19.0 | 3.7 | 16.2 | 19.2 | 3.8 | 16.4 | 0 | 0 | 0.3 | 2 | 0 | 0.4 |
| Comparison Example 15 | 7.5 | 3.2 | 10.0 | 10.1 | 2.8 | 12.0 | 0 | 2 | 0.2 | 0 | 23 | 0.3 |
| Comparison Example 16 | 98 | 2.9 | 18.0 | 211 | 2.0 | 24 | 18 | 0 | 1.6 | 69 | 1 | 1.6 |
| Comparison Example 17 | 0.21 | 4.1 | 1200 | 0.35 | 3.8 | 1350 | 0 | 25 | 0.9 | 0 | 85 | 5.2 |
| Comparison Example 18 | 1000< | 0.9 | 10000< | — | — | — | 32 | 0 | 2.8 | 96 | 1 | 6.2 |

*$PCO_2 \times 10^{10}$ $cm^3 \cdot s \cdot cmHg$, $PH_2O \times 10^9$ $cm^3(STP)cm/cm^2 \cdot s \cdot cmHg$ As understood from Table 6, with the use of poly 4-methylpentene 1 having a large carbon dioxide permeability coefficient in the comparison example 16, the permeability coefficient ratio was small so that the permeability of oxygen became relatively larger. Further, since film breakage and cracking occurred due to a low temperature folding process, there was a tendency of increasing $P_{CO_2}$ but further decreasing $P_{CO_2}/P_{O_2}$. On reflection of these permeability characteristics, the respiration were not substantially restrained under the storage test for the corrugated fiber board packages. Thus, the plums yellowed even three days oxide permeability coefficient and a high $P_{CO_2}/P_{O_2}$ ratio. The yellowing was relatively restrained, and further, browning does not occur while a relatively small weight reduction was caused. That is, a well balanced keeping quality was ensured, and even though the fruits were left after unsealing, no signal of respiration disorder was found. Further, this coating resin was also excellent in process ability for folding, and substantially no variation in permeability was found.

COMPARISON TEST 6

A blend of LDPE (ρ=0.918) and ultra low density LLDPE having a ratio of 80:20 were used an embodiment 10, a blend of those having a ratio of 60:40 for an embodiment 11, a blend thereof having a ratio of 40:60 for an embodiment 12 and ultra low density LLDPE (C4, ρ=0.903) for an embodiment 13, and accordingly, they were extruded by a film thickness of 25 μm in conformity with the method in the embodiment 9, and were laminated with 220 g/m$^2$ base weight of a corrugate fiber board liner paper material. These resin coated liner paper materials were evaluated for their gas and water-vapor permeabilities. Meanwhile, with the use of these liner materials as outer liners, 180 g/m$^2$ base weight of a corrugating mediums and 220 g/m$^2$ of an inner liner coated with LDPE (density ρ=0.918) having a film thickness of 25 μm were sealed to each of the liner material with the use of water base bond (Konishi #645) so as to obtain corrugated fiber board. The corrugated fiber boards were subjected to a usual punch-process and an assembly process by the above-mentioned method so as to prepare A-1 type corrugated fiber board package (having a length L=288 mm, a width W=190 mm and a height H=115 mm).

Meanwhile, in order to provide comparison examples, a blend of LDPE (ρ=0.198) and LLDPE (C8, ρ=0.927) having a ratio of 60:40 was used for a comparison example 20, and a blend of LDPE (ρ=0.918) and a bend of ultra low density LLDPE (C4, ρ=0.903) having a ratio of 90:10 was used for a comparison example 21.

Further, a comparison example 19 in which a conventional corrugated fiber board package having no resin coating was used, for comparison and accordingly, seven kinds of packages in total were prepared. Each of the packages was packed with 2 kg of kabosus (variety: Ohita No. 1) which were harvested in the middle of September and were then pretreated and pre-cooled, and the upper and lower flap abutting parts and the lap end parts including the corner parts were sealed in an H-like shape with the use of an adhesive tape having a width of 40 mm and composed of biaxially stretched polypropyrene as a base material, and the end parts of the joint flaps were sealed so as to completely seal the package. Then, the packages were stored in an atmosphere at 20° C. and 65% RH. After two storage months, the packages were unsealed, and the quality of the kabosus were evaluated so as to obtain (1) a proportion (%) of conforming kabosus having supple pericarps with sufficiently held green color, (2) proportions (%) of A: yellowing, B: pitting, C: browning, D: molding and the like and (3) a weight reduction ratio with respect to the initial total weight as a reference per package (storage zone I). Then, the fruits which were satisfactory preserved, were again sealed by the above-mentioned method on assumption of physical distribution using these packages, and were left at 20° C. and at 65% RH for two weeks. Thereafter, the packages were again unsealed, and the qualities thereof were evaluated (storage zone II).

Table 7 summarizes the water-vapor transmission rates of the respective resin coated paper materials, and the results of storage tests for kabosus in the corrugated fiber board packages formed from these paper materials.

TABLE 7

| | Gas Permeability in Resin Coated Paper* | | | | | | Storage Test Results of Corrugated Fiber Board | | | | | | |
|---|---|---|---|---|---|---|---|---|---|---|---|---|---|
| | A. Without Low Temperature Folding Process | | | B. Without Low Temperature Folding Process | | | Storage Zone I | | | Storage Zone II | | | |
| | $PCO_2$ | $PCO_2/PO_2$ | $PH_2O$ | $PCO_2$ | $PCO_2/PO_2$ | $PH_2O$ | Acceptable Proportion | Unacceptable Proportion** | Weight Reduction Ratio | Acceptable Proportion | Unacceptable Proportion** | Weight Reduction Ratio |
| Comparison Example 19 | — | — | — | — | — | — | 0 | A: 98<br>D: 2 | 6.5 | — | — | — |
| Comparison Example 20 | 6.5 | 3.6 | 8.2 | 8.1 | 3.2 | 10.1 | 80 | B: 15<br>C: 3<br>D: 2 | 0.4 | 25 | B: 58<br>C: 13<br>D: 4 | 1.3 |
| Comparison Example 21 | 8.1 | 3.3 | 10.3 | 8.5 | 3.0 | 11.0 | 90 | B: 8<br>C: 2 | 0.5 | 48 | B: 41<br>C: 10<br>D: 1 | 1.0 |
| Embodiment 10 | 10.5 | 3.5 | 13.1 | 10.7 | 3.5 | 13.5 | 97 | B: 2.5<br>D: 0.5 | 0.7 | 95 | B: 4.5<br>D: 0.5 | 0.8 |
| Embodiment 11 | 21.0 | 3.7 | 17.1 | 20.8 | 3.8 | 17.3 | 99 | B: 1.0 | 0.7 | 97 | A: 0.5<br>D: 2.5 | 0.9 |
| Embodiment 12 | 26.3 | 3.9 | 19.5 | 26.0 | 3.8 | 19.3 | 99 | A: 1.0 | 0.8 | 98 | A: 1.5<br>B: 0.5 | 1.0 |
| Embodiment 13 | 30.2 | 4.0 | 20.2 | 29.5 | 3.9 | 20.0 | 99 | A: 1.0 | 0.9 | 97 | A: 3.0 | 1.1 |

*$PCO_2 \times 10^{10}$cm$^3$(STP)cm/cm$^2$ · s · cmHg, $PH_2O \times 10^9$cm$^3$(STP)cm/cm$^2$ · s · cmHg
**A: Yellowing; B: Pitting; C: Browning; D: Other defects such as molding (%).

With the conventional corrugated fiber board package having no resin coating in the comparison example 19, respiration could not be restrained, and accordingly, substantially all fruits yellowed even under a low temperature storage test, and a relatively large weight reduction was exhibited. Further, even thought either the blend of LDPE and usual LLDPE was used for the coating resin in the comparison example 20 or the blend of LDPE and a small quantity of ultra low density LLDPE was used for that in the comparison example 21, since the carbon dioxide permeability coefficient was remarkably small, and further micro cracking occurred in the coating layer upon fabrication so that the permeability coefficient ratio becomes lower, it was difficult to sufficiently restrain the respiration of the produce in the sealed package. Thus, in the case of the storage of kabosus, pitting and browning largely occurred due to respiration disorder. In particular in such a case that they were sealed again after they were unsealed and returned to a room temperature condition from a low temperature storage condition, since the respiration became abruptly brisk, the number of unconforming fruits increased, and accordingly, remarkable lowering of the quality, such as occurrence of molding or the like accompanied with softening of the pericarps were found.

On the contrary, in such a case that ultra low density LLDPE was blended by a quantity greater than a predetermined value for the composition of the coating resin layer in the embodiments 10 to 13, a relatively large carbon dioxide permeability coefficient and a relatively large permeability coefficient ratio were obtained, and they were not largely altered, even though they were fabricated. Accordingly, even in the case of the storage of kabosus, the insides of the sealed packaged using these resin coated paper materials could be held in a respiration restraining condition, and accordingly, a practically satisfactory keeping quality could be obtained even in any one of the storage zones.

COMPARISON TEST 7

A blend of LLDP (ρ=0.918) and ultra low density LLDPE (C6, ρ=0.910) having a ratio of 40:60 was used for an embodiment 14, and a blend of LDPE (ρ=0.918), ultra low density LLDPE (C6, ρ=0.910) and SB copolymer with hydro-additive, having a ratio of 40:30:30 for an embodiment 15, and a blend of LDPE (ρ=0.918), and ultra low density LLDPE (C6, ρ=0910) and ethylene-vinyl acetate copolymer (VA 20%), having a ratio of 40:30:30 for an embodiment 16. Each of these blends was extruded by a film thickness of 20 μm, and was laminated over the outer surface of a mixed paper material composed of pulp and PE group synthetic pulp and having a base weight of 400 g/m$^2$ in conformity with method in the embodiment 1. The gas and water-vapor transmission rate characteristics of the these resin coated paper materials were evaluated, and further, were subjected to a press forming method so as to prepare trays (having a width of 110 mm, a length of 160 mm and a height of 30 mm) having flanges for heat seal.

Further, for comparison, a coated paper material obtained, similar to the embodiment 1, by using LLDPE (C4, ρ=0.920) having a film thickness of 20 μm was prepared as a comparison example 23, and a tray having no coating was prepared as a comparison example 22. Thus five kinds of packages in total were prepared. Each of the trays was packed with 300 g of yellow peaches (variety: Satoh Nishiki) immediately after harvest, and the tray flange was heat-sealed with the use of a film having a thickness of 40 μm, made of a blend of ultra low density LLDPE (ρ=0.905) and LLDPE (ρ=0.920), having a ratio of 70:30, and also having an anti-fog ability. Ten trays for each kind were stored in an atmosphere at 22° C. and at 65% RH for ten days in a quality preserving condition. The quality of them were evaluated so as to obtain a proportion of conforming articles, and a proportions of unconforming articles (Proportions of A: withering, B: stalk or pedicel falling-off, C: browning and D: molding and the like) and a weight reduction ratio.

In the case of using the conventional tray in the comparison example 22 having no resin coating, the respiration was brisk, and accordingly, the withering and the stem effect accompanied with the former were advanced, and the pedicel falling-off occurred much while the weight was greatly reduced. That is, a tendency of aging was clearly found and the cherries completely lost its commercial value. Further, in the case of using usual LLDPE for the coating resin in the reference example 23, it was inferior in process ability for press forming so that the curved surfaces of the corner parts of the tray had a tendency of cracking, and micro cracking occurred during a folding process. Thus, variation, in the water-vapor transmission rate was found, and in particular, a selective permeability coefficient ratio decreased. On reflection with these characteristics, the concentration of carbon dioxide gas was remarkably high in the package under storage test, and accordingly, the pericarps much browned being accompanied with respiration disorder, resulting in occurrence of alcoholic odor. Further, occurrence of mold due to softening of the fruit flesh was caused. Thus, the commercial value thereof as lost.

Meanwhile, in the case of the embodiments 14 to 16 in which the ultra low density LLDPE was used as component of the resin coating, the press forming ability was excellent, and there was exhibited a satisfactory keeping quality with which the respiration could be restrained suitable for the content due to a high carbon dioxide water-vapor transmission rate and a high selective permeability coefficient ratio necessary for moderate supply of oxygen. In particular, in the case of using hydrogen additive of styrene-butadiene block copolymer in the embodiment 15 or ethylene-vinyl acetate copolymer (vinyl acetate content of 20 mol %), the selective permeability coefficient ratio was large, and accordingly, the effect of improving the keeping quality was found.

The results of the test are shown in Table 8.

TABLE 8

| | Gas Permeability in Resin Coated Paper* | | | | | | Storage Test Results of Tray | | | |
|---|---|---|---|---|---|---|---|---|---|---|
| | A: Without Low Temperature Folding Process | | | B: Without Low Temperature Folding Process | | | Acceptable | Unacceptable | | Weight Reduction |
| | $PCO_2$ | $PCO_2/PO_2$ | $PH_2O$ | $PCO_2$ | $PCO_2/PO_2$ | $PH_2O$ | Proportion | Proportion* | | Ratio |
| Comparison Example 22 | — | — | — | — | — | — | 5 | A:<br>B:<br>C: | 45<br>48<br>2 | 4.2 |
| Comparison Example 23 | 7.6 | 3.2 | 10.2 | 9.5 | 2.3 | 12.1 | 29 | C:<br>D: | 66<br>5 | 0.6 |
| Embodiment 14 | 18.5 | 3.6 | 15.2 | 18.4 | 3.7 | 15.0 | 98 | B: | 2 | 0.8 |

TABLE 8-continued

| | Gas Permeability in Resin Coated Paper* | | | | | | | | | |
|---|---|---|---|---|---|---|---|---|---|---|
| | A: Without Low Temperature Folding Process | | | B: Without Low Temperature Folding Process | | | Storage Test Results of Tray | | | |
| | $PCO_2$ | $PCO_2/PO_2$ | $PH_2O$ | $PCO_2$ | $PCO_2/PO_2$ | $PH_2O$ | Acceptable Proportion | Unacceptable Proportion* | | Weight Reduction Ratio |
| Embodiment 15 | 25.1 | 4.1 | 19.2 | 24.9 | 4.0 | 19.4 | 99.5 | B: | 0.5 | 1.0 |
| Embodiment 16 | 26.2 | 3.9 | 21.1 | 26.0 | 3.9 | 21.3 | 99 | B: | 1 | 1.1 |

*$PCO_2 \times 10^{10} cm^3(STP)cm/cm^2 \cdot s \cdot cmHg$, $PH_2O \times 10^9 cm^3(STP)cm/cm^2 \cdot s \cdot cmHg$
**A: Yellowing; B: Pitting; C: Browning; D: Other defects such as molding (%).

COMPARISON TEST 8

Embodiment 17

A blend of LDPE (ρ=0.919) and ultra low density LLDPE (C4, ρ=0.905), having a ratio of 50:50 was extruded by a film thickness of 15 μm, and was laminated with 50 g/m$^2$ base weight of a thin wrapping paper material in conformity with the method in the previously mentioned embodiment. The water-vapor transmission of this simile material were: $P_{CO_2}=15.6\times10^{-10}$ cm$^3$(STP)cm/cm$^2$·s·cmHg $P_{CO_2}/P_{O_2}=3.7$, and $P_{H_{2+sc}O}=13.2\times10^{-9}$ cm$^3$(STP)cm/cm$^2$·s·cmHg. With the use of this coated paper material as a cover material, a package capable of storing therein a spherical fruit having a diameter of 60 mm, which was formed by vacuum molding from an LLDPE (C4, ρ=0.918) film having a thickness of 120 μm, was packed therein with a kabosu which was pre-cooled and pretreated and heat-sealed, and was heat-sealed under vacuum of −50 mHg.

500 packages which were prepared as mentioned above were stored at 5° C. for three months. Even though a part of the fruits was defective due to scratches on the pericarps thereof caused upon the harvest, the proportion of conforming articles was satisfactory, that is 98.6%. Then, these packages were packed in corrugated fiber board packages, 100 g for each package, and were transported by 1,000 km on a consolidation truck. Thereafter, they were stored at a room temperature for two weeks on assumption of physical distribution therefor. There were no occurrences of defects such as pin holes in the packages, and in particular in the cover material, and further, the green color of the kabosus was sufficiently held, that is, it was found that the fresh-keep effect was excellent.

COMPARISON TEST 9

Embodiment 18

The coated paper material in the embodiment 17 was adhered at three sides thereof so as to form a bag having a length of 280 mm and a width of 120 mm in which three fruits can be stored. The bag was then packed with three kabosus therein and the opening of the bag was sealed by winding an adhesive tape therearound after the bag was evacuated. The permeability characteristics of this bag were: $P_{CO_2}15.6\times10^{-10}$ cm$^3$(STP) cm/cm$^2$·s·cmHg, $P_{CO_2}/P_{O_2}=3.7$, and $P_{H_{2+sc}O}=13.2\times10^{-9}$ cm$^3$(STP)cm/cm$^2$·s·cmHg. The 500 packages which were prepared as mentioned above, were stored at 5° C. for three months. Even though a part of the fruits was defective due to scratches on the pericarps thereof caused in the harvest, the proportion of conforming articles was quite satisfactory, that is, 98.6%. Then, these packages were packed in corrugated fiber board package, 10 kg for each package, and were transported by 1,000 km on a consolidation truck. Thereafter, they were stored at a room temperature for 2 weeks on assumption of physical distribution therefor. There were no occurrences of defects such as pin holes in the packages, particularly in the cover material, and further, the green color of the kabosus were sufficiently held, that is, it was found that the fresh-keep effect was excellent.

Advantageous effect of the present invention is mentioned hereinbelow:

- Preservation packages formed of corrugated fiber board according to the present invention are remarkably excellent in the fresh-keep effect for produce, and that is, the produce can be preserved for a long period during which it freshness was prevented from deteriorating.
- With the use of sealing methods according to the present invention, the corner parts of the package can be completely sealed, and accordingly, the gas composition in the package can be held.
- Further, with the use of wrapping paper according to the present invention, produce can fall in a dormant condition, and accordingly, the freshness thereof can be preserved so that the storage period therefor can be greatly prolonged.
- Further, by adjusting the gas composition in the package according to the present invention, there can be exhibited such an excellent effect that the freshness of produce therein can be held for a long storage period.

COMPARISON TEST 9

Embodiment 9

A corrugated fiber board liner paper material having 220 g/m$^2$ base weight was used as one base material and a thin craft paper of 50 g/m$^2$ base weight as the other base material. A blend of low density polyethylene (LDPE), polymerized at high pressure, and ultra low density polyethylene (LLDPE), which is a copolymer of ethylene and butene-1, at a weight ratio of 60 to 40, were melted and extruded between the two base materials at a thickness of 20 μm, then the sandwitch lamination or the poly sandwitch liner was formed. The conditions for this process were as follows: The temperature of resin directly under a die ranged from 320° to 325° C., the lamination speed was 100 m/min, and the corona treatment on the liner paper surface was performed at 5 kw. Corrugated fiber board, with the thin craft paper side of the poly sandwich liner as an outer surface, was produced by pasting to the fiber board liner a corrugated core material of 180 g/m$^2$ base weight and then a 220 g/m$^2$ base weight liner, of which the inner side was covered with 30 μm thick LDPE, by using a corrugator and a water base bond. An A-1 shape fiber board box (length 288 mm, width 199 mm, height 115 mm), as specified in JIS Z 1507, was made by cutting this fiber board with a die in the conventional way, applying flexographic printing on the thin craft paper, and gluing joints with a hot-melt adhesive. The $P_{CO_2}$ of this poly sandwich liner was $13.6\times10^{10}$ cm$^3$(STP)cm·cm$^2$·s$^{-1}$·cmHg$^1$. Water vapor permeability of the inner resin coated liner was 32.5 g/m$^2$·day.

Embodiment 10

Another type of corrugated fiber board box (same size and same manner as in Embodiment 9 in terms of corrugating, die cut, and joint pasting) was produced. The outer liner consisted of a fiber board liner paper of 220 g/m$^2$ base weight which was coated with a 20 μm thick resin of a blend of low density polyethylene (LDPE), which was polymerized at high pressure, and ultra low density poly ethylene (LLDPE), which was a copolymer of ethylene and butene-1 at a weight ratio of 60 to 40. The inner liner was a poly sandwich liner comprised of a 30 μm thick, high-pressure polymerized low density poly ethylene (LDPE), laminated between a liner paper of 220 g/m$^2$ base weight as one mase material and a thin craft paper of 50 g/m$^2$ base weight, as the other base material. This box has the thin craft paper at the innermost surface. The outer resin coated liner's $P_{CO_2}$ was $15.0\times10^{10}$ cm$^3$(STP)cm·cm$^{-2}$·s·cmHg$^{-1}$ and the inner poly sandwich liner's water vapor permeability was 30 g/m$^2$·day.

As compared to regular-resin coating, a poly sandwich liner tended to allow slightly lower gas permeability and water vapor permeability, but the differences were not significant enough to affect the gas permeability requirement for fiber board containers.

The following freshness preservation tests were conducted using four types of boxes These included the two types described above and one with an inner and an outer surface structured with resin coated liner, as described in Embodiment 1. The fourth was a common fiber board box without resin coat layers, as described in Comparative Example 3.

Freshness Preservation Test: Part 1

Six pieces of broccoli (variety: Haitsu) (approximately 1.7 kg), harvested at the end of November, were packed into each box. The boxes were sealed, leaving the exposed ends of the side joints as air permeability adjustment areas, as shown in FIG. 2. Twenty cases were prepared for each type of box. Five cases were bundled together with plastic bands, transported overnight with mixed freight from Kyushu to Tokyo (1000 km), and stored at room temperature. Evaluation of the contents was done four days after the broccoli was packaged. Table 9 shows the results of the evaluation. The results of Embodiment 1 and Comparative Example 3 are different from those shown in Table 1 because the tests were conducted on the different occasions.

TABLE 9

| | Gas Composition in Corrugated Fiber Board Packages (%) | | Maximum Compression Weight | Storage Test Results of Corrugated Fiber Board (%, n = 120) | | | |
|---|---|---|---|---|---|---|---|
| | | | | Acceptable | Unacceptable | | Weight Reduction |
| | $O_2$ | $CO_2$ | in (%) | Proportion | Proportion | | Ratio |
| Embodiment 1 | 15.9 | 2.2 | 86.5 | 92 | A: | 4 | 1.6 |
| | (16.6–13.5) | (1.9–2.8) | | | B: | 4 | |
| Embodiment 9 | 14.1 | 2.5 | 87.1 | 96 | A: | 0 | 1.5 |
| | (14.8–13.4) | (2.2–3.1) | | | B: | 4 | |
| Embodiment 10 | 16.0 | 2.4 | 86.8 | 95 | A: | 5 | 2.1 |
| | (16.8–13.6) | (1.8–3.0) | | | B: | 0 | |
| Comparison | 20.8 | 0 | 62.1 | 12 | A: | 62 | 12.5 |
| Example 3 | (20.1–20.8) | | | | B: | 2 | |
| | | | | | C: | 24 | |

Note: A: Yellowing of flower buds; B: Slime at cut areas (Marketable if cut off); and C: Withering.

The results show that conventional fiber board boxes, as seen in Comparative Example 3, cause yellowing of flower buds, and are thus poor at preserving freshness. In comparison, applying a poly sandwich liner to either the inner or the outer surface of the fiber board boxes preserved about the same level of freshness as did a resin coating layer on either the inner or the outer surface. However, close examination shows that the effects were slightly different. If the resin coating layer was on the outer surface of the outer liner, and that layer became scratched or damaged during transportation, the resulting rise in oxygen concentration within the boxes turned the flower buds yellow. In this test, there was a correlation between damage to the boxes and changes in the gas concentration, and the resulting yellowing. A similar trend was observed in Embodiment 10, where the same material was used for the outer liner. In Embodiment 9, in which a poly laminated liner was used as an outer liner, no yellowing occurred and quality was fairly consistent. This freshness preservation corresponds to the fact that there were only minute changes in the gas concentration within the box. Therefore, if produce is transported, it is effective to use a poly sandwich liner, which has a thin craft paper as the outermost layer, as in Embodiment 9. That way, the box can be printed using a regular flexographic printer, which is superior in terms of printing appearance, printing speed, fading of ink, and blocking, as compared to printing directly on the resin layer. Adverse effects resulting from damages during transportation can also be minimized.

When a poly laminated liner was used as the inner liner (Embodiment 10), it made no difference to gas composition inside the box. There was a tendency for the contents to lose slightly more weight, but not enough to cause the contents to wilt. Substantial differences were observed, however, at the cut parts of broccoli. Slime occurred when using a simple resin coated liner, but this problem was not seen when a poly laminated liner was used. When the resin coated liner was used, condensation formed large water droplets on the liner surface that when in contact with the cut areas of broccoli resulted in a slimy condition. The slime problem can be resolved by placing a sheet of thin paper at the bottom of the container. The use of a poly-laminated liner apparently provided an effect similar to paper put in the bottom of the container.

As described above, even though the effects are slightly different, both a resin coated liner and a poly laminated liner provide similar container performance. Appropriate selection is necessary, however, based on the shapes and the handling of such containers, the printing requirement, and the types of contents.

Freshness Preservation Test: Part 2

Next, the following test was conducted for spinach distribution using the A-1 shape fiber board boxes (length 400 mm, width 140 mm, height 100 mm) made of the aforementioned four types of fiber board materials, namely, Embodiments 1, 9 and 10 and Comparison Example 3.

Each of the fiber board boxes were packed with 500 g of spinach, which was refrigerated in a vacuum precooler at 5° C. for two hours after harvesting. Boxes were completely sealed, as shown in FIG. 3, using 40 mm wide adhesive tape made of biaxial stretching polypropylene. Five cases were prepared for each type of fiber board construction, and they were stored in an atmosphere of 20° C. and 60% relative humidity. After six days, the boxes were opened and the quality of the spinach was evaluated. Results are shown in Table 10.

TABLE 10

| | Gas Composition in Corrugated Fiber Board Packages (%) | | Maximum Compression Weight | Storage Test Results of Corrugated Fiber Board (%, Total Weight 500 g) | | | |
|---|---|---|---|---|---|---|---|
| | | | | Acceptable | Unacceptable | | Weight Reduction |
| | $O_2$ | $CO_2$ | in (%) | Proportion | | Proportion | Ratio |
| Embodiment 1 | 5.4 | 15.2 | 82.5 | 100 | | 0 | 2.5 |
| Embodiment 9 | 6.1 | 13.2 | 81.6 | 100 | | 0 | 2.6 |
| Embodiment 10 | 5.6 | 15.9 | 82.0 | 99 | A: | 1 | 4.1 |
| Comparison Example 3 | 20.4 | 0.1 | 52.1 | 0 | A: | 90 | 32.9 |
| | | | | | B: | 10 | |

Note: A: Withering; B: Mold.

The results show that spinach in the conventional fiber board box in Comparison Example 3 lost substantial weight and wilted due to the box's lack of transpiration control. By contrast, produce preservation was evident for both the resin coated liner and the poly sandwich liner. Because of the container's compressive load resistance, the base weight ($g/m^2$) of the material comprising the container walls can be kept to less than that of conventional fiber board. Close observation indicates some differences depending on the liner structure. That is, if a poly sandwich liner was used as the outer liner, gas permeability tends to increase slightly; $O_2$ concentration was higher, and $CO_2$ concentration was lower. The level of difference in gas composition, however, did not affect the quality of freshness of the contents. If a poly sandwich liner was used as the inner liner, the innermost thin craft paper absorbed moisture. Thus, the contents tended to have slightly greater weight loss and wilting in some cases A regular resin coated liner, if used as the innermost surface, tends to collect large water drops on its surface, depending on the storage temperatures, causing mold and rot. Use of the poly sandwich liner as an inner liner is effective in preventing these problems, however.

What is claimed is:

1. A package for preserving freshness of a produce, comprising:

a corrugated fiber board composed of:

(A) an outer wall having a carbon dioxide permeability coefficient $Pco_2$ of $5\times10^{-10}$ $cm^3(STP)cm/cm^2\cdot s\cdot cmHg$ or greater at a temperature of 27° C.;

(B) a corrugating medium; and (C) an inner wall having a water-vapor transmission rate of 100 $g/m^2$ day or less at a temperature of 27° C.; and sealing tape substantially sealing end parts of the corrugated fiber board which are exposed to an outer surface of the package.

2. A package for preserving freshness of a produce as set forth in claim 1, wherein the package has a ratio $Pco_2/Po_2$ between a carbon dioxide permeability coefficient and an oxygen permeability coefficient which is 1.5 or greater.

3. A package for preserving freshness of a produce as set forth in claim 1, wherein the inner wall includes an inner liner and a resin layer formed onto the inner liner as an innermost layer, the resin layer having a water-vapor transmission rate of 100 $g/m^2\cdot day$ or less at a temperature of 27° C.

4. A package for preserving freshness of a produce as set forth in claim 1, wherein the outer wall includes an outer liner and a resin layer formed onto the outer liner as an outer most layer, the resin layer having a carbon dioxide permeability coefficient of $5\times10^{-10}$ $cm^3(STP)cm/cm^2\cdot s\cdot cmHg$ or greater at a temperature of 27° C.

5. A package for preserving freshness of a produce as set forth in claim 1, wherein the outer wall includes a resin layer containing less than 0.917 $g/cm^3$ density of a copolymer of ethylene and α-olefin having a carbon number of 3 to 12, the outer wall having a carbon dioxide permeability coefficient $Pco_2$ of $8\times10^{-10}$ $cm^3(STP)cm/cm^2\cdot s\cdot cmHg$ or greater, a ratio $Pco_2/Po_2$ between the carbon dioxide permeability coefficient $Pco_2$ and an oxygen permeability coefficient $Po_2$ of 3.5 or greater, and a water-vapor transmission coefficient of $80\times10^{-9}$ $cm^3(STP)cm/cm^2\cdot s\cdot cmHg$ or less.

6. A package for preserving freshness of a produce as set forth in claim 5, wherein the copolymer of ethylene and α-olefin having a carbon number 3 to 12 is ultra low density LLDPE having a density of 0.912 or less.

7. A package for preserving freshness of produce as set forth in claim 1, wherein the seal tape seals surfaces of exposed end parts of the corrugated fiber board at a bottom, cover and corner portion of the package, and also seals exposed end parts of the corrugated fiber board in mated parts of the side surfaces of the package.

8. A package for preserving freshness of a produce as set forth in claim 1, wherein the outer wall is formed from a poly sandwich liner including a first base material, a second base material, and a resin layer interposed between the first base material and the second base material.

9. A package for preserving freshness of a produce as set forth in claim 8, wherein the resin layer has a carbon dioxide permeability coefficient $Pco_2$ of $5\times10^{-10}$ $cm^3(STP)cm/cm^2\cdot s\cdot cmHg$ or greater at a temperature of 27° C.

10. A package for preserving freshness of a produce as set forth in claim 1, wherein the inner wall is formed from a poly sandwich liner including a first base material, a second base material, and a resin layer interposed between the first base material and the second base material.

11. A package for preserving freshness of a produce as set forth in claim 10, wherein the resin-layer has a water-vapor transmission rate of 100 $g/m^2\cdot day$ or less at a temperature of 27° C.

12. A package for preserving freshness of a produce as set forth in claim 1, wherein the package has a ratio $Pco_2/Po_2$ between a carbon dioxide permeability coefficient $Pco_2$ and an oxygen permeability coefficient $Po_2$ which is 3.5 or greater.

13. A package for preserving freshness of a produce as set, forth in claim 1, wherein the outer wall includes a resin formed from one or more of the group of low density polyethylene, polystryrene, a styrenebutadiene copolymer, a styreneisoprene copolymer, an ethylene-methylmethacrylate-nonconjugate dienenta-polymer, and a resin material containing at least one of ethylene, α-olefin, vinyl acetate, acrylate, and methacrylate.

14. A package for preserving freshness of a produce as set forth in claim 13, wherein the resin is adhered to a paper base, and the resin has been subjected to graft denaturation.

15. A package for preserving freshness of a produce as set forth in claim 13, wherein the resin includes a copolymer of ethylene and α-olefin having a carbon number of 3 to 12.

16. A package for preserving freshness of a produce as set forth in claim 15, wherein the resin includes a blend of at least two of the group of an ethylene-butane-1 copolymer, an ethylene-hexene-1 copolymer, an ethylene-4-methylpentene-1 copolymer, and an ethylene-octane-1 copolymer.

17. A package for preserving freshness of a produce as set forth in claim 13, wherein the resin is one of a low density ethylene-α-olefin copolymer in which the copolymeric ratio of α-olefin is relatively high and an ultra low density ethylene-α-olefin copolymer in which the copolymeric ratio of α-olefin is high, blended with one or more of a combination of low density polyethylene and an ethylene-hexene-1 copolymer, a combination of low density polyethylene and an ethylene-butane-1 copolymer, and a combination of low density polyethylene and an ethylene-hexene-1 copolymer.

18. A package for preserving freshness of a produce as set forth in claim 13, wherein the resin is blended with a one or more selected from the group an antioxidant, a heat stabilizing agent, a lubricant, and antifogging agent, an anti-charge agent, an inorganic filler, and a pigment.

19. A package for preserving freshness of a produce as set forth in claim 13, wherein the resin is formed in a layer from 5 μm to 60 μm thick.

20. A package for preserving freshness of a produce as set: forth in claim 19, wherein the resin is formed in a layer from 10 μm to 40 μm thick.

21. A package for preserving freshness of a produce as set: forth in claim 1, wherein the sealing tape is formed of a biaxially stretched nylon or high density polyethylene.

22. A package for preserving freshness of a produce, comprising:

a corrugated fiber board composed of:

(A) an outer wall having a carbon dioxide permeability coefficient $Pco_2$ of $5\times10^{-10}$ $cm^3(STP)cm/cm^2\cdot s\cdot cmHg$ or greater at a temperature of 27° C.; and (B) an inner wall having a water-vapor transmission rate of 100 $g/m^2\cdot day$ or less at a temperature of 27° C.;

the package having a ratio $Pco_2/Po_2$ between a carbon dioxide permeability coefficient and an oxygen permeability coefficient of 1.5 or greater; and sealing tape substantially sealing end parts of the corrugated fiber board which are exposed to an outer surface of the package, the sealing tape being sealed to abutting parts of the corrugate fiber board at bottom and cover parts of the package so as to seal the inside of the package, a seal sheet of the sealing tape having a length longer than a length of the associated side of the package being sealed to each of the corner parts over three surfaces of adjacent side portions and either the bottom or cover portion, end parts of the sheet which are not yet sealed to these surfaces being sealed together so as to form a sealed piece surrounding and sealing the corner parts, and end parts of the sheets which are not sealed together and which would otherwise project being sealed and fixed to the package, and sealing tape being sealed to the end parts of the corrugated fiber board which are exposed to the outer surface of the package in joined parts of the corrugated fiber-board in the side surface portions of the package, excepting necessary gas transmission adjusting parts.

23. A package for preserving freshness of a produce as set forth in claim 22, wherein the sealing tape is sealed to each corner part in such a way that one end part of the seal sheet sealed to one surface of the package is folded so as to seal one part thereof to another surface of the package while the remaining part thereof is sealed to the end part of the sealing sheet sealed to the one surface so as to form a triangular sealed piece which surrounds and seals the corner part.

24. A package for preserving freshness of a produce as set forth in claim 22, wherein end parts of the seal sheet which are not sealed together are sealed to the rear surface of the seal sheet sealed to the package.

25. A package for preserving freshness of a produce as set forth in claim 22, wherein the inner wall includes an inner liner with a resin layer formed onto the inner liner as an innermost layer, the resin layer having a water vapor transmission rate of 100 $g/m^2\cdot day$ or less at a temperature of 27° C.

26. A package for preserving freshness of a produce as set forth in claim 22, wherein the outer wall includes an outer liner with a resin layer formed onto the outer liner as an outermost layer, the resin layer having a carbon dioxide permeability coefficient of $5\times10^{-10}$ $cm^3(STP)cm/cm^2\cdot s\cdot cmHg$ or greater at a temperature of 27° C.

27. A package for preserving freshness of a produce as set forth in claim 22, wherein the package has a ratio $Pco_2/Po_2$ between a carbon dioxide permeability coefficient $Pco_2$ and an oxygen permeability coefficient $Po_2$ which is 3.5 or greater.

28. A package for preserving freshness of a produce as set forth in claim 22, wherein the outer wall includes a resin formed from one or more of the group of low density polyethylene, polystryrene, a styrenebutadiene copolymer, a styreneisoprene copolymer, an ethylene-methylmethacrylate-nonconjugate dienenta-polymer, and a resin material containing at least one of ethylene, α-olefin, vinyl acetate, acrylate, and methacrylate.

29. A package for preserving freshness of a produce as set forth in claim 28, wherein the resin is adhered to a paper base, and the resin has been subjected to graft denaturation.

30. A pack for preserving freshness of a produce as set forth in claim 28, wherein the resin includes a copolymer of ethylene and α-olefin having a carbon number of 3 to 12.

31. A package for preserving freshness of a produce as set forth in claim 30, wherein the resin includes a blend of at least two of the group of an ethylene-butane-1 copolymer, an ethylene-hexene-1 copolymer, an ethylene-4-methylpentene-1 copolymer, and an ethylene-octane-1 copolymer.

32. A package for preserving freshness of a produce as set forth in claim 28, wherein the resin is one of a low density ethylene-α-olefin copolymer in which the copolymeric ratio of α-olefin is relatively high and an ultra low density ethylene-α-olefin copolymer in which the copolymeric ratio of α-olefin is high, blended with one or more of a combination of low density polyethylene and an ethylene-hexene-1 copolymer, a combination of low density polyethylene and an ethylene-butane-1 copolymer, and a combination of low density polyethylene and an ethylene-hexene-1 copolymer.

33. A package for preserving freshness of a produce as set forth in claim 28, wherein the resin is blended with a one or more selected from the group an antioxidant, a heat stabilizing agent, a lubricant, an antifogging agent, an anticharge agent, an inorganic filler, and a pigment.

34. A package for preserving freshness of a produce as set forth in claim 28, wherein the resin is formed in a layer from 5 μm to 60 μm thick.

35. A package for preserving freshness of a produce as set forth in claim 34, wherein the resin is foamed in a layer from 10 μm to 40 μm thick.

36. A package for preserving freshness of a produce as set forth in claim 22, wherein the sealing tape is formed of a biaxially stretched nylon or high density polyethylene.

37. A fresh-keep produce pack characterized in that produce is stored in a package for preserving freshness of a produce, which is formed of a corrugated fiber board composed of:

(A) an outer liner having a carbon dioxide permeability coefficient $Pco_2$ of $5\times10^{-10}$ $cm^3(STP)cm/cm^2\cdot s\cdot cmHg$ or greater at a temperature of 27° C.;

(B) a corrugating medium; and (C) an inner liner having a water-vapor transmission rate of 100 $g/m^2\cdot day$ or less at a temperature of 27° C., and further, end parts of the corrugate fiber board which are exposed to an outer surface of the package are substantially sealed with a seal tape, corner parts are also sealed with the seal tape, and the seal tape is sealed to the exposed end parts of the corrugate fiber board in joined parts of side surfaces of the package, excepting necessary gas-transmission adjusting parts, whereby the package has a ratio $Pco_2/Po_2$ between carbon dioxide permeability coefficient and oxygen permeability coefficient of 1.5 or greater.

* * * * *